US008150274B2

(12) United States Patent
Miyazaki et al.

(10) Patent No.: US 8,150,274 B2
(45) Date of Patent: Apr. 3, 2012

(54) APPARATUS AND METHOD FOR IMAGE FORMING

(75) Inventors: Satoshi Miyazaki, Kawasaki (JP); Tomoyuki Takahira, Yokohama (JP); Toshio Kitazawa, Ichikawa (JP); Kazuma Saitoh, Tokyo (JP); Hideaki Matsui, Kawasaki (JP)

(73) Assignee: Ricoh Company, Ltd., Tokyo (JP)

( * ) Notice: Subject to any disclaimer, the term of this patent is extended or adjusted under 35 U.S.C. 154(b) by 529 days.

(21) Appl. No.: 12/285,956

(22) Filed: Oct. 17, 2008

(65) Prior Publication Data

US 2009/0103933 A1 Apr. 23, 2009

(30) Foreign Application Priority Data

Oct. 22, 2007 (JP) ..... 2007-274247
Oct. 31, 2007 (JP) ..... 2007-284235

(51) Int. Cl.
*G03G 15/00* (2006.01)

(52) U.S. Cl. ..... 399/12

(58) Field of Classification Search ..... 399/12, 399/25, 27, 111, 119, 262
See application file for complete search history.

(56) References Cited

U.S. PATENT DOCUMENTS

| | | | | |
|---|---|---|---|---|
| 6,011,935 | A | 1/2000 | Matsuzaka et al. | |
| 6,909,856 | B2 * | 6/2005 | Crichton | 399/12 |
| 7,027,744 | B2 * | 4/2006 | Simpson et al. | 399/12 |
| 7,516,318 | B2 * | 4/2009 | Eun | 713/1 |
| 2006/0245767 | A1 | 11/2006 | Burchette et al. | |
| 2007/0140722 | A1 | 6/2007 | Kobayashi et al. | |
| 2009/0116854 | A1 | 5/2009 | Kitazawa et al. | |

FOREIGN PATENT DOCUMENTS

| | | |
|---|---|---|
| JP | 10-151832 | 6/1998 |
| JP | 10-161508 | 6/1998 |
| JP | 2004-013904 | 1/2004 |

* cited by examiner

*Primary Examiner* — Hoang Ngo
(74) *Attorney, Agent, or Firm* — Harness, Dickey & Pierce, PLC

(57) ABSTRACT

An image forming apparatus is provided with a process cartridge that is removable from the image forming apparatus. When the process cartridge is installed, the image forming apparatus automatically searches a print job that matches the process cartridge that is currently installed onto the image forming apparatus.

15 Claims, 19 Drawing Sheets

FIG. 9

140

| INDEX NO. | USER NAME | JOB NAME | TIME | PAGE | JOB TYPE |
|---|---|---|---|---|---|
| 01 | A | INVOICE A | 09281010 | 1 | |
| 02 | B | CHECK A | 09281730 | 1 | MICR |
| 03 | B | CHECK B | 10010930 | 1 | MICR |
| 04 | C | REPORT B | 10011400 | 1 | |
| 05 | C | CHECK C | 10020930 | 1 | MICR |

APPARATUS AND METHOD FOR IMAGE FORMING

CROSS-REFERENCE TO RELATED APPLICATIONS

This patent application is based on and claims priority under 35 U.S.C. §119 to Japanese Patent Application Nos. 2007-274247, filed on Oct. 22, 2008, and 2007-284235, filed on Oct. 31, 2007, in the Japanese Patent Office, the disclosure of which is hereby incorporated herein by reference.

FIELD OF THE INVENTION

The present invention generally relates to an apparatus and a method of image forming, and more specifically to an apparatus and a method of image forming capable of operating under more than one type of process cartridge.

BACKGROUND

Recently, an image forming apparatus is provided, which is capable of operating under more than one type of process cartridge. For example, as described in the Japanese Patent Application Publication No. H10-161508, a regular process cartridge, which is installed onto the apparatus body of the image forming apparatus, may be replaced with a magnetic ink character recognition (MICR) process cartridge as needed.

Further, the recent image forming apparatus is capable of storing one or more print jobs that are received from the outside apparatus through a network. When the stored print jobs include more than one type of print job each requiring the use of different type of process cartridge as in the case described in the Japanese Patent Application Publication No. H10-161508, the user may be required to go through several steps before identifying the print job that matches the type of process cartridge being currently installed onto the apparatus.

SUMMARY

Example embodiments of the present invention include an image forming apparatus, which includes: an image forming device provided with one of a first process cartridge and a second process cartridge each removable from the image forming apparatus; a storage device to store therein a print job; a detector to detect installation of one of the first process cartridge and the second process cartridge onto the image forming apparatus; and a controller to be activated by the detector when installation of one of the first process cartridge and the second process cartridge is detected and to automatically search through the storage device to obtain a print job that matches the type of one of the first process cartridge and the second process cartridge that is currently installed.

Example embodiments of the present invention include a print job management method including: storing a print job previously received by an image forming apparatus in a storage device; detecting installation of one of a first process cartridge and a second process cartridge onto the image forming apparatus; and automatically searching through the storage device to obtain a print job that matches the type of one of the first process cartridge and the second process cartridge that is currently installed when the detecting detects installation of one of the first process cartridge and the second process cartridge.

Example embodiments of the present invention include an image forming method including: storing a print job previously received by an image forming apparatus in a storage device; detecting installation of one of a first process cartridge and a second process cartridge onto the image forming apparatus; automatically searching through the storage device to obtain a print job that matches the type of one of the first process cartridge and the second process cartridge that is currently installed when the detecting detects installation of one of the first process cartridge and the second process cartridge; and forming an image of print data for the print data that matches the type of the first process cartridge and the second process cartridge that is currently installed.

Example embodiments of the present invention include a recording medium, which stores a plurality of instructions which, when executed by a processor, causes the processor to perform a job management operation including: storing a print job previously received by an image forming apparatus in a storage device; detecting installation of one of a first process cartridge and a second process cartridge onto the image forming apparatus; and automatically searching through the storage device to obtain a print job that matches the type of one of the first process cartridge and the second process cartridge that is currently installed when the detecting detects installation of one of the first process cartridge and the second process cartridge.

Example embodiments of the present invention include an image forming apparatus, which includes: an image forming device provided with one of a first process cartridge and a second process cartridge each removable from the image forming apparatus; a communication device to receive a print job from a network; and a controller to determine whether the received print job matches the type of one of the first process cartridge and the second cartridge that is currently installed and to automatically store the received print job when the received print job does not match the type of one of the first process cartridge and the second process cartridge that is currently installed.

Example embodiments of the present invention include an image forming apparatus, which includes: an image forming device provided with one of a first process cartridge and a second process cartridge each removable from the image forming apparatus; a communication device to receive a print job from a network; and a controller to determine whether the received print job requires the use of the second process cartridge and to automatically store the received print job when the received print job requires the use of the second process cartridge.

Example embodiments of the present invention include an image forming system including an information processing apparatus and an image forming apparatus, which are connected through a network. The image forming apparatus is provided with a process cartridge removable from the image forming apparatus, with the process cartridge being one of a first process cartridge and a second process cartridge. The information processing apparatus may generate a print job, which includes job management information indicating the type of the print job that corresponds to one of the type of the first process cartridge and the type of the second process cartridge. When the image forming apparatus receives the print job from the information processing apparatus, the image forming apparatus may determine whether the received print job matches the type of one of the first process cartridge and the second process cartridge that is currently installed using the job management information, and automatically store the received print job when the received print job does not match the type of one of the first process cartridge and the second process cartridge that is currently installed. Alternatively, the image forming apparatus may determine whether the received print job requires the use of the second process cartridge using the job management information, and automatically store the received print job when the received print job requires the use of the second process cartridge.

In addition to the above, the present invention may be practiced in various other ways.

BRIEF DESCRIPTION OF THE DRAWINGS

A more complete appreciation of the disclosure and many of the attendant advantages and features thereof can be readily obtained and understood from the following detailed description with reference to the accompanying drawings, wherein:

FIG. 9 is an example table storing information regarding a print job, which may be provided in the printer shown in FIG. 1, according to an example embodiment of the present invention;

Figure 1:
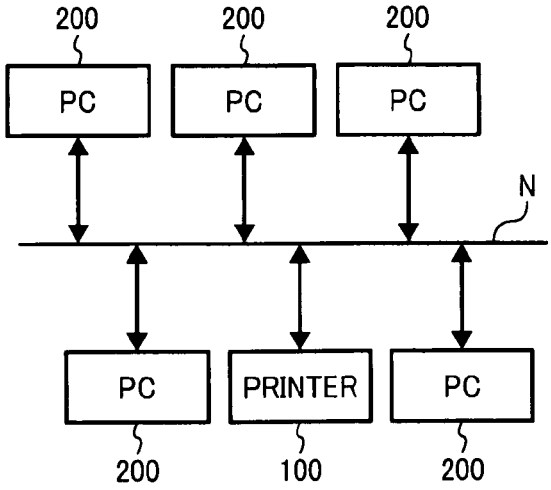
FIG. 1 is a configuration of an image forming system according to an example embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION OF EXAMPLE EMBODIMENTS

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

Referring now to FIG. 1, a configuration of an image forming system is explained according to an example embodiment of the present invention. The image forming system of FIG. 1 includes a printer 100 and a plurality of personal computers (PCs) 200, which are connected through a network N such as a local area network (LAN) or the Internet.

In this example, the printer 100 may be implemented by a printer of any desired type capable of performing a print job received from the PC 200 through the network N. The PC 200 may each be implemented by a general-purpose computer capable of generating a print job, for example, using a printer driver, which may be installed onto a memory provided to the PC 200.

The image forming system of FIG. 1 may be implemented in various other ways. For example, the printer 100 may be implemented by any desired image forming apparatus such as a multifunctional apparatus (MFP) capable of providing any image forming function such as scanning, faxing, copying, printing, etc. In another example, the PC 200 may be implemented by any desired information processing apparatus such as a portable phone, personal digital assistance (PDA), digital camera, etc. Further, the image forming system of FIG. 1 may be provided with any number of devices or apparatus such that the number of printers 100 or the number of PCs 200 is not limited to the number shown in FIG. 1.

Figure 2:
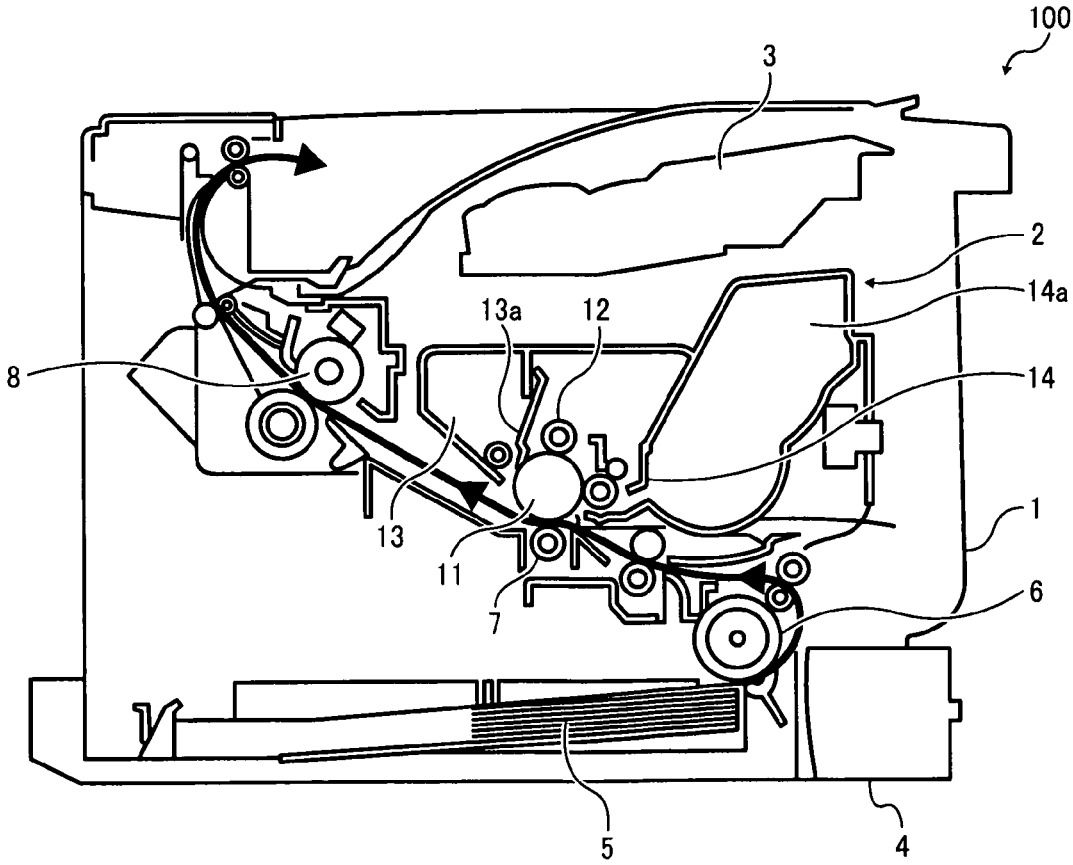
FIG. 2 is a cross-sectional view illustrating an inner structure of a printer shown in FIG. 1, according to an example embodiment of the present invention.

Referring now to FIG. 2, a structure of the printer 100 is explained according to an example embodiment of the present invention. The printer 100 includes an apparatus body 1, and a process cartridge 2 provided in the apparatus body 1. The process cartridge 2 includes a photoconductive device 11, a charging device 12, a disposed toner collecting device 13 including a cleaning device 13*a*, and a developing device 14 including a toner storage 14*a*, which are integrally provided. With these devices, the process cartridge 2 is capable of performing image formation as described below. Further, in this example, the process cartridge 2 is removable from the apparatus body 1.

The printer 100 further includes an optical writing device 3, which irradiates a light onto the surface of the photoconductive device 11. The optical writing device 3 includes a plurality of devices such as a polygon motor, polygon mirror, f-theta lens, laser diode, and mirror. The printer 100 further includes a sheet storage device such as a sheet tray 4, a sheet transfer device such as a pick up roller 6 and a transfer roller 7, and a fixing device such as a fixing roller 8.

Figure 3:
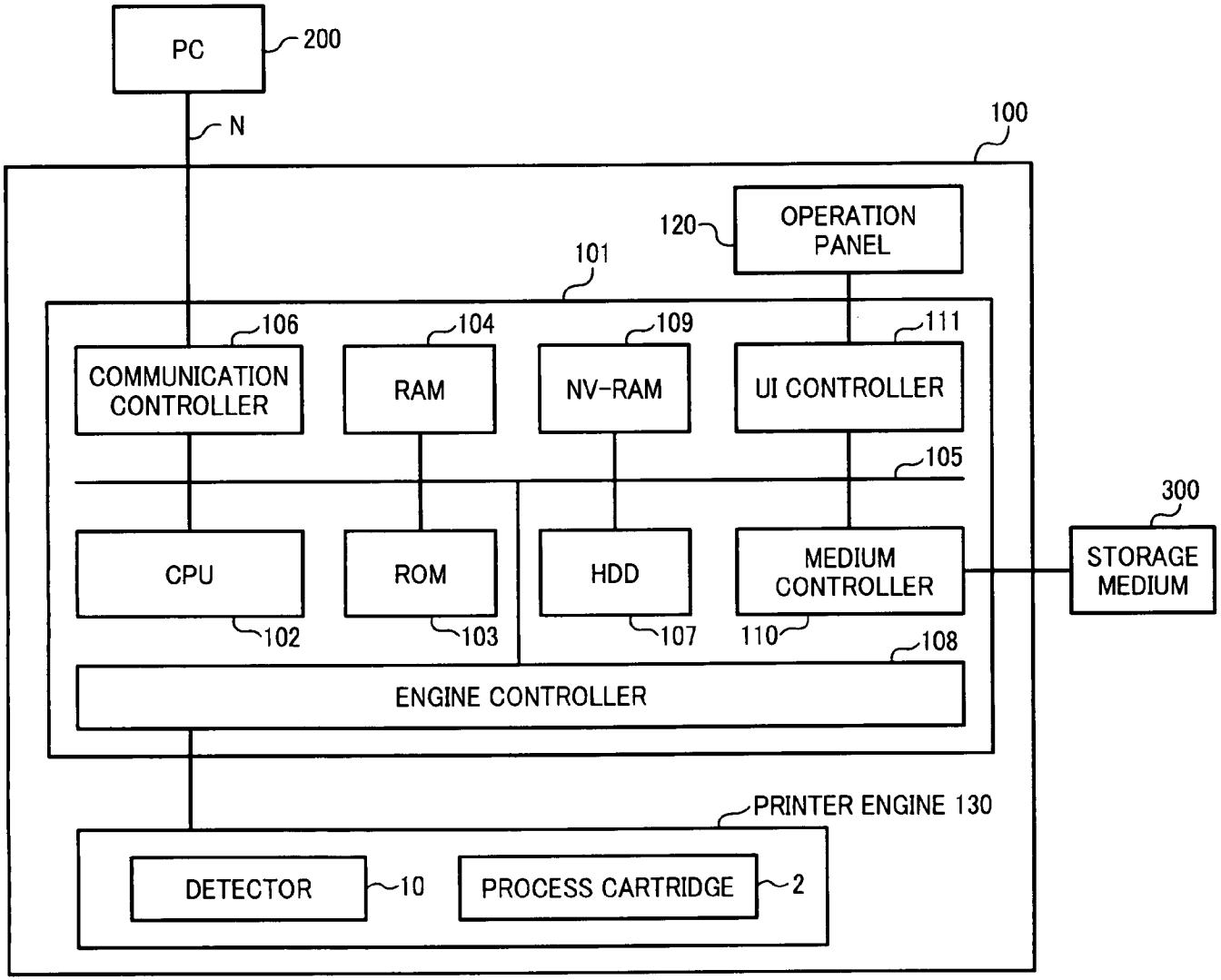
FIG. 3 is a schematic block diagram illustrating a structure of the printer shown in FIG. 1, according to an example embodiment of the present invention.

Referring now to FIG. 3, the printer 100 further includes a controller 101, an operation panel 120, and a printer engine 130. The operation panel 120 may function as a user interface capable of interacting with a user, for example, as described below referring to FIG. 7. The printer engine 130 includes a plurality of image forming devices that together perform image formation, such as the process cartridge 2, the optical writing device 3, the transfer roller 7, and the fixing roller 8. The printer engine 130 may further include a detector 10, which detects installation or replacement of the process cartridge 2.

The controller 101 controls operation of the printer 100. For example, when a print job is received from the PC 200 through the network N, the controller 101 converts the print data to drawing data, and outputs the drawing data to the printer engine 130 to cause the printer engine 130 to print an image specified by the drawing data onto a recording medium such as a recording sheet 5 (FIG. 2). The controller 101 includes a central processing unit (CPU) 102, a read only memory (ROM) 103, a random access memory (RAM) 104, a communication controller 106, a hard disk drive (HDD) 107, a nonvolatile RAM (NV-RAM) 109, a medium controller 110, and a user interface (UI) controller 111, which are connected through an internal bus 105.

The CPU 102 may be implemented by any desired processor capable of controlling operation of the printer 100 according to a program. The ROM 103 may store various data such as a program to be executed by the CPU 102. The RAM 104 may function as a work area for the CPU 102, a buffer that temporarily stores one page of print data, or a bitmap memory that stores video data converted from the print data.

The communication controller 106, which may be implemented by an interface card, may allow the printer 100 to communicate with the outside apparatus through the network N. As described above referring to FIG. 1, in this example, the communication controller 106 may receive data such as a print job from the PC 200, or sends data such as notification to the PC 200 under control of the CPU 102.

The HDD 107 may store various data such as data to be printed or information regarding the print job to be performed by the printer 100. The HDD 107 may further store an operating system (OS) program or an application program such as an image forming program. In example operation, when the power of the printer 100 is turned on, the OS program, which may be stored in the HDD 107, may be read onto the RAM 104. The CPU 102 may run any desired application program on the OS program. Alternatively, the printer 100 may not be provided with the HDD 107. In such case, various data may be stored in any desired memory such as the NV-RAM 109 or the ROM 103.

The NV-RAM 109 may store various data in a form such that it is not deleted even after the power of the printer 100 is turned off. For example, as described below, the NV-RAM 109 may store information regarding the print job to be performed by the printer 100, or information regarding settings of the printer 100.

The medium controller 110 may read data from or write data onto a storage medium 300. For example, the medium controller 110 may be implemented by an interface or a slot, to which the storage medium such as a secure digital (SD) card may be inserted. For example, the storage medium 300 may store therein an application program to be executed by the CPU 102. When the storage medium 300 is inserted, the medium controller 110 reads the application program, and stores the application program onto the HDD 107 or any desired memory provided in the printer 100. Alternatively, any desired application program may be downloaded from the network N via the communication controller 106. In alternative or addition to the application program, any other kind of program such as the OS or a firmware program may be stored in the storage medium 300 or obtained from the network N.

In another example, the storage medium 300 may store information regarding the user, which may be checked by the printer 100 to determine whether the user is authorized to use the printer 100.

The UI controller 111 allows the controller 101 to exchange data with the operation panel 120. For example, the UI controller 111 may receive any data input by the user through the operation panel 120. In another example, the UI controller 111 may output any data generated by the controller 101 to the operation panel 120 for display to the user.

The engine controller 108 controls operation of the printer engine 130 under control of the CPU 102. For example, when instructed by the CPU 102 to process a print job, the engine controller 108 causes the printer engine 130 to form an image according to the print job.

In one example, the printer 100 is capable of forming an image according to the print job received from the outside. When the communication controller 106 receives the print job from the PC 200 through the network N, the controller 101 interprets the print job to determine processing to be applied to the print job, and applies the determined processing to the print job. Further, the controller 101 outputs an instruction to perform the print job to the printer engine 130 via the engine controller 108. When the instruction for printing is received from the controller 101, the printer engine 130 performs image forming operation.

For example, referring back to FIG. 2, the pick-up roller 4 feeds the recording sheet 5, one by one, from the sheet tray 4 toward the photoconductive device 11 of the process cartridge 2 at predetermined timing, which may be determined by the controller 101. The photoconductive device 11 rotates in the clockwise direction. As it rotates, the surface of the photoconductive device 11 is uniformly charged by the charging device 12. The optical writing device 3 irradiates a light, which is modulated according to the print data received from the controller 101, onto the charged surface of the photoconductive device 11 such that a latent image of the print data is formed thereon. The developing device 14 develops the latent image onto a toner image using toner obtained from the toner storage 14*a*. The transfer roller 7 transfers the toner image formed on the surface of the photoconductive device 11 onto the recording sheet 5 at a nip formed between the photoconductive device 11 and the transfer roller 7. The recording sheet 5 having the toner image thereon is further transferred to the fixing roller 8. At a nip formed between the fixing roller 8 and a pressure roller that faces the fixing roller 8, the image formed on the recording sheet 5 is fixed by heat and pressure. The recording sheet 5 having the fixed image thereon is output from the printer 100, as indicated by the arrow in FIG. 2.

Figure 4:
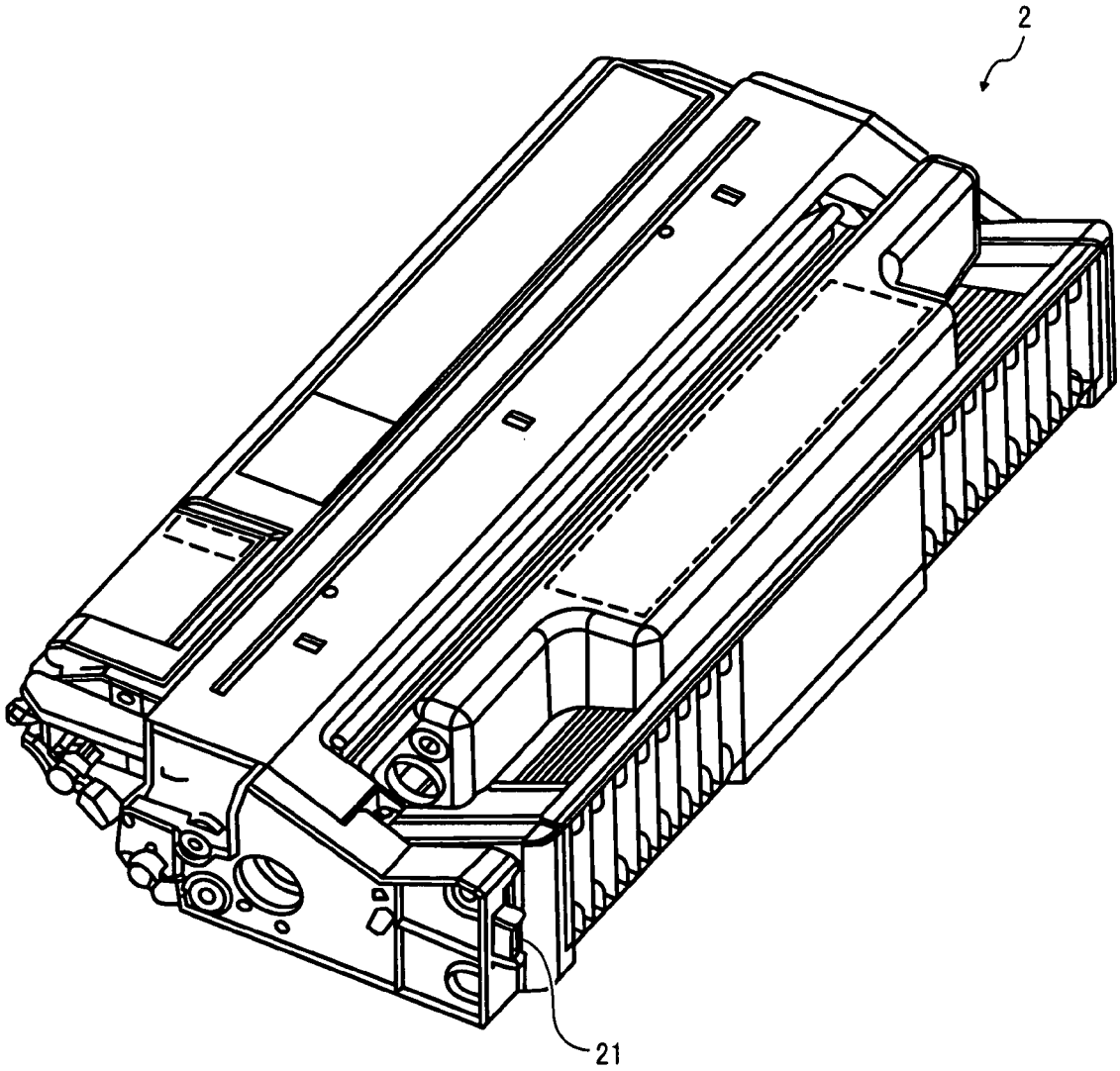
FIG. 4 is a perspective view illustrating a process cartridge installable onto the printer shown in FIG. 1, according to an example embodiment of the present invention.
Figure 5:
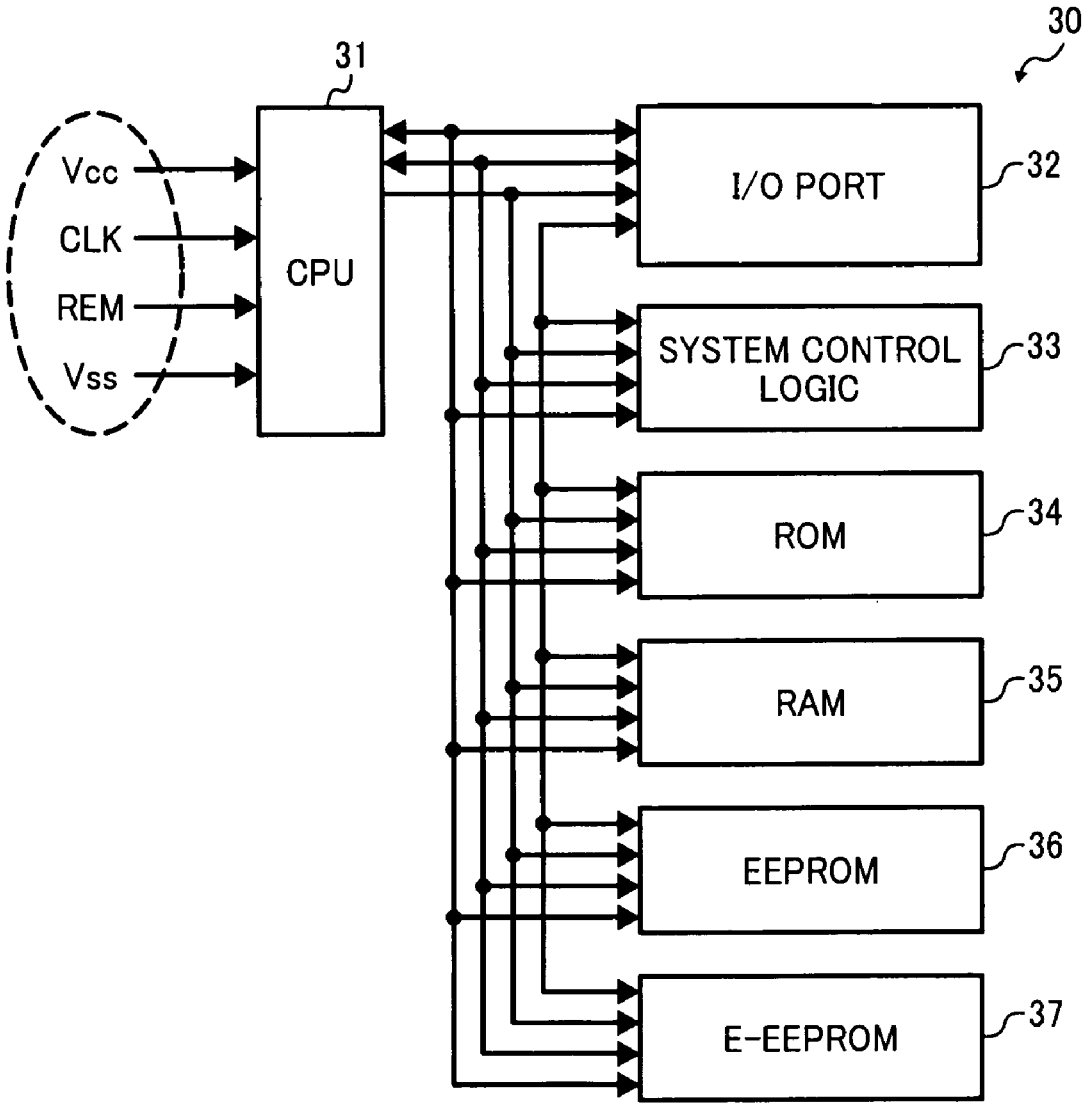
FIG. 5 is a schematic block diagram illustrating a structure of an integrated circuit (IC) chip of the process cartridge shown in FIG. 4, according to an example embodiment of the present invention.

Referring to FIGS. 4 and 5, a structure of the process cartridge 2 is explained according to an example embodiment of the present invention. The process cartridge 2 is provided with a connector 21. The connector 21 includes an integrated circuit (IC) chip 30 shown in FIG. 5.

Referring to FIG. 5, the IC chip 30 includes a CPU 31, an input/output (I/O) port 32, a system control logic circuit 33, a ROM 34, a RAM 35, an electrically erasable programmable ROM (EEPROM) 36, and an E-EEPROM 37, which are coupled through a signal line. The CPU 31 controls operation of the process cartridge 2. The I/O port 32 may be implemented by an interface that allows communication with the printer 100, for example, in compliance with ISO 7816. The system control logic circuit 33 controls the IC chip 30. The ROM 34 may function as a work area for the CPU 31. The E-EEPROM 37 may store information, which may control data to be written onto the EEPROM 36.

The EEPROM 36 may store information regarding the process cartridge 2 including, for example, cartridge identification number, information regarding various image forming conditions such as the light intensity or duration when exposing or charging, the developing bias, etc., cartridge lot number, cartridge manufacturing date and time, cartridge type, date and time when the cartridge is firstly used, the number of pages printed by the cartridge, number of being recycled, limit on the number of being recycled, date and time when each unit is replaced, toner lot number, toner level, etc.

As described above referring to FIG. 2, the process cartridge 2 may be removed from the apparatus body 1 of the printer 100. In one example, the process cartridge 2 may be removed so as to be replaced with a new process cartridge. In another example, the process cartridge 2 may be removed so as to be replaced with a process cartridge having a cartridge type different from the type of the process cartridge 2 being installed. Specifically, in this example, it is assumed that the process cartridge 2 being installed onto the printer 100 is one of a MICR process cartridge and a process cartridge other than the MICR process cartridge. For the descriptive purpose, the process cartridge other than the MICR process cartridge, which includes a toner cartridge, for example, may be referred to as a regular process cartridge.

The regular process cartridge and the MICR process cartridge are substantially similar in structure and function. The differences include type of toner stored in the toner storage 14*a* and information stored in the EEPROM 36. In the case of MICR process cartridge, magnetic toner is stored. Further, in the case of MICR process cartridge, the information regarding the cartridge indicates that the process cartridge 2 is the MICR process cartridge. Further, information regarding various image forming conditions may differ between the MICR process cartridge and the regular process cartridge.

By replacing the regular process cartridge with the MICR process cartridge, the printer 100 may function as a MICR printer capable of forming an image with magnetic toner stored in the MICR process cartridge. In such case, paper specialized for MICR printing is assumed to be used as the recording sheet 5.

When the process cartridge 2 is installed onto the apparatus body 1 of the printer 100, the IC chip 30 of the connector 21 is connected to the controller 101 of the printer 100. With this connection, the bias power supply may be provided from the printer 1 to the IC chip 30 through the I/O port 32 to activate the IC chip 30. When the IC chip 30 is activated, information stored in the EEPROM 36 may be sent to the controller 101. For example, when the MICR process cartridge is installed, information regarding the MICR process cartridge such as the cartridge type is sent to the controller 101. Once information is provided from the process cartridge 2, the controller 101 may store such information in the memory 112 such as the NV-RAM 109 (FIG. 3). Using the information being stored, the controller 101 is able to control operation of the process cartridge 2, for example, during image forming operation, according to various image forming conditions specifically designed for the MICR process cartridge.

Further, in this example, the detector 10 of FIG. 3 may detect when the process cartridge 2 is installed. For example, the detector 10 may be implemented by a sensor capable of detecting whether the process cartridge 2 is currently installed onto the apparatus body 1. The sensor may include any desired kind of sensor including, for example, magnetic sensor or reflective sensor. When the process cartridge 2 is installed, the detector 10 may output a detection signal indicating that the process cartridge 2 is installed to the controller 110. Upon receiving the detection signal, the controller 110 may perform print job management operation as described below.

In another example, the detector 10 may be implemented by a sensor capable of detecting whether the process cartridge 2 is replaced from the regular process cartridge to the MICR process cartridge, or from the MICR process cartridge to the regular process cartridge. When replacement of the process cartridge 2 is detected, the detector 10 may output a detection signal indicating that the process cartridge 2 is replaced. Upon receiving the detection signal, the controller 110 may perform print job management operation as described below.

Figure 6:
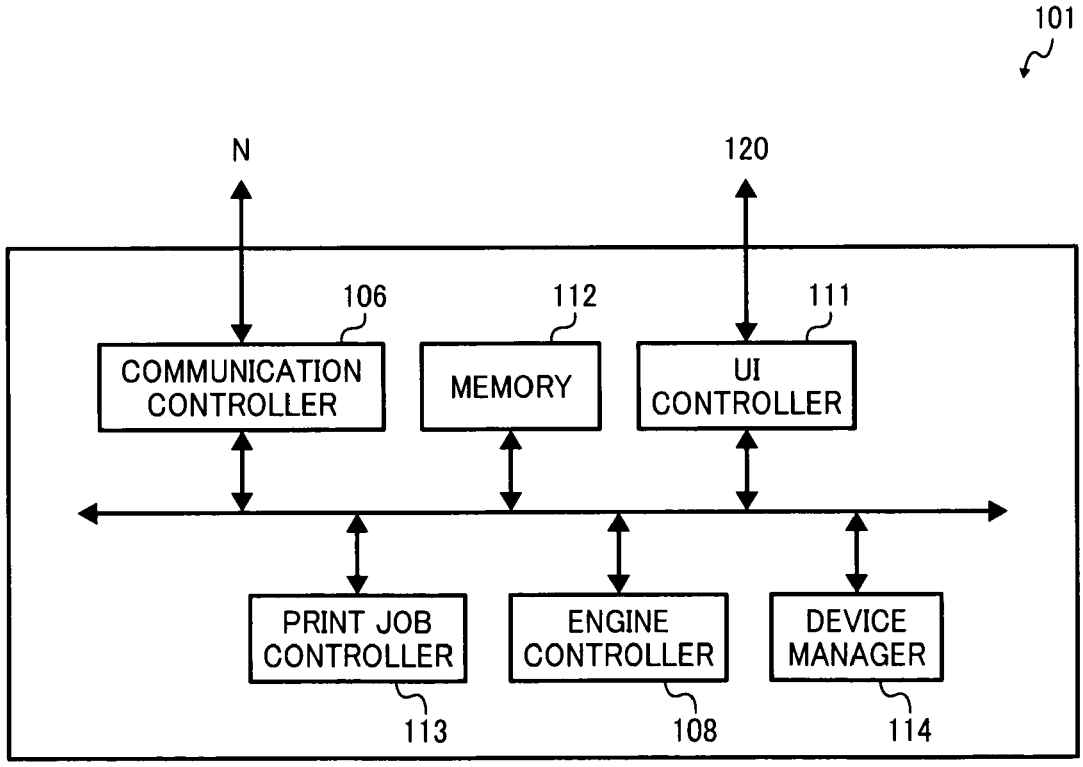
FIG. 6 is a schematic block diagram illustrating a functional structure of a controller of the printer shown in FIG. 1, according to an example embodiment of the present invention.

Referring now to FIG. 6, a functional structure of the controller 110 is explained, which relates to print job management operation, according to an example embodiment of the present invention. The controller 110 includes the communication controller 106, the engine controller 108, the UI controller 111, a memory 112, a print job controller 113, and a device manager 114. The memory 112 may be any one of the RAM 104, NV-RAM 109, ROM 103, HDD 107, and storage medium 300. According to a print job management program, which may be obtained from the memory 112 or through the network N via the communication controller 106, the CPU 102 may perform operation of managing a print job, for example, using other devices such as the print job controller 113 and the device manager 114. For example, when installation or replacement of the process cartridge 2 is detected by the detector 10, the print job management program may be executed by the CPU 102 to cause the CPU 102 to carry out print job management operation by using the print job controller 113, the device manager 114, or the UI controller 111. In another example, when the print job is received from the PC 200 through the network N, the print job management program may be executed by the CPU 102 to cause the CPU 102 to carryout print job management operation by using the print job controller 113, the device manager 114, or the UI controller 111. In another example, when the power of the printer 100 is turned on or when the mode of the printer 100 is changed from the energy save mode to the operation mode, the print job management program may be executed by the CPU 102 to cause the CPU 102 to perform print job management operation by using the print job controller 113, the device manager 114, or the UI controller 111.

The print job controller 113 may control a print job to be performed by the printer 100 or information regarding the print job to be performed by the printer 100. In one example, when a print job is received from the PC 200 through the communication controller 106, the print job controller 113 may determine a type of the print job and determine processing to be applied to the print job based on the print job type. In another example, the print job controller 113 may search a specific print job, from the print job being stored in the memory 112. In another example, the print job controller 113 may request the printer engine 130 to perform a print job through the engine controller 108.

The device manager 114 may control information regarding the devices of the printer 100 including the process cartridge 2. For example, the device manager 114 may be notified by the detector 10 when the process cartridge 2 is installed onto the apparatus body 1. In such case, the device manager 114 may obtain information regarding the process cartridge 2 from the IC chip 30, such as information regarding the cartridge type, and store the obtained information in the memory 112.

Figure 7:
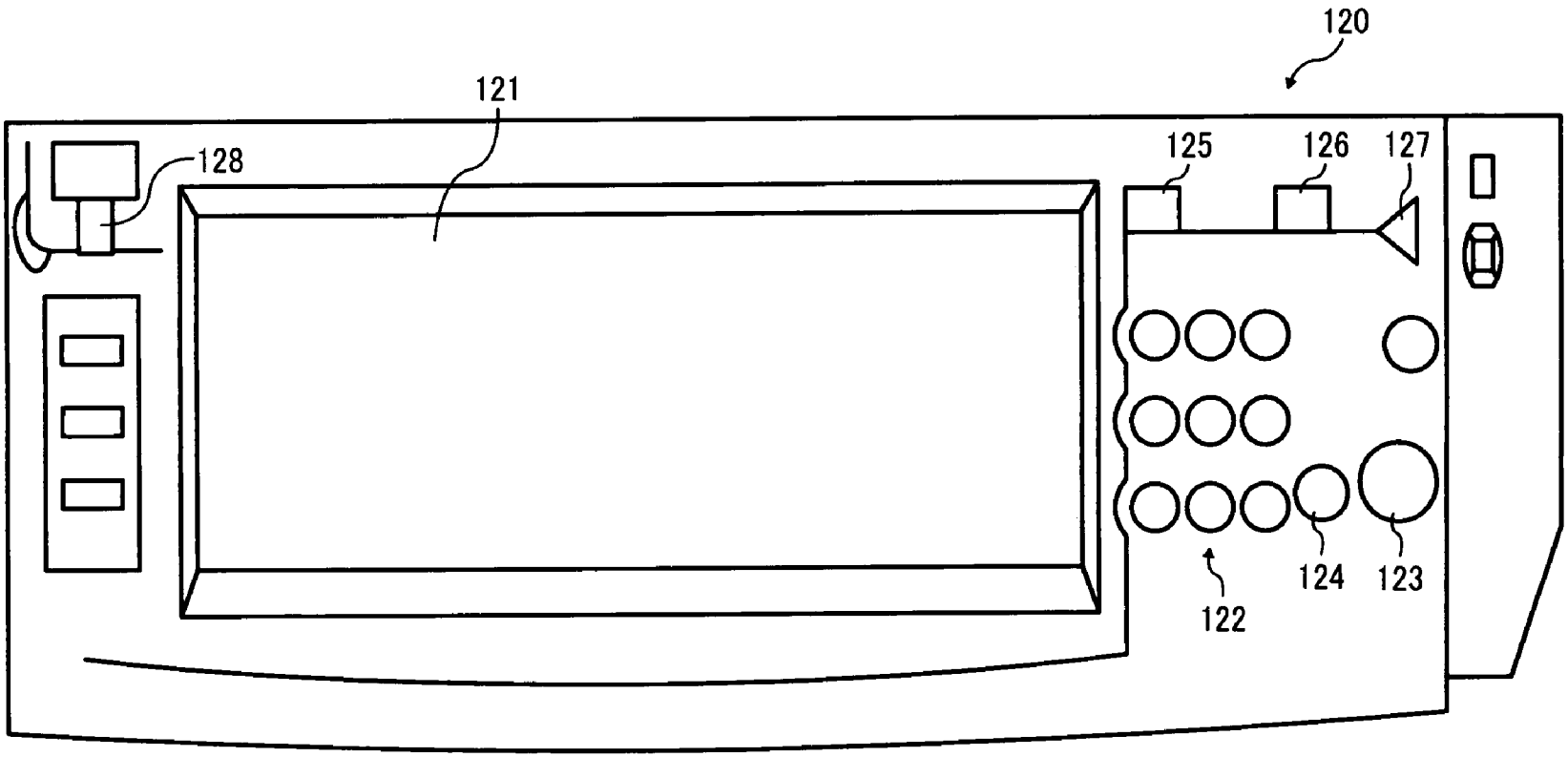
FIG. 7 is a front view illustrating a structure of an operation panel of the printer shown in FIG. 1, according to an example embodiment of the present invention.

Referring now to FIG. 7, the structure and function of the operation panel 120 are explained according to an example embodiment of the present invention. The operation panel 120 may send information received from the user to the UI controller 111 (FIG. 3) of the controller 101. Alternatively, the operation panel 120 may output information, which may be generated by the controller 101, for example, in response to the information received from the user. As shown in FIG. 7, the operation panel 120 includes a display 121 provided in a central section of the operation panel 120. In this example, the display 121, which is capable of displaying various information, is implemented by a liquid crystal display (LCD) integrated with a touch panel. The touch panel may allow the user to make the selection or instruction according to the contents of the screen displayed by the LCD. The selection or instruction made by the user is sent to the UI controller 111.

The operation panel 120 additionally includes various kinds of keys including a ten key 122, a start key 123, a clear/stop key 124, a program key 125, a reset/save mode key 126, an interrupt key 127, and a setting key 128. The ten key 122 allows the user to input numerical data. The start key 123 allows the user to request the printer 100 to perform the user instruction previously input. The clear/stop key 124 allows the user to cancel the user instruction previously input or stop the operation currently performed by the printer 100. The program key 125 allows the user to recall the user instruction previously stored in the memory 112 of the printer 100. The reset/save mode key 126 allows the user to reset the user instruction previously input to return to the default settings or change the mode of the printer 100 between the operation mode and the energy save mode. The interrupt key 127 allows the user to interrupt the operation currently performed by the printer 100. The setting key 128 allows the user to input various settings or change the default settings according to user preference, and stores information set by the user in the memory 112.

Figure 8:
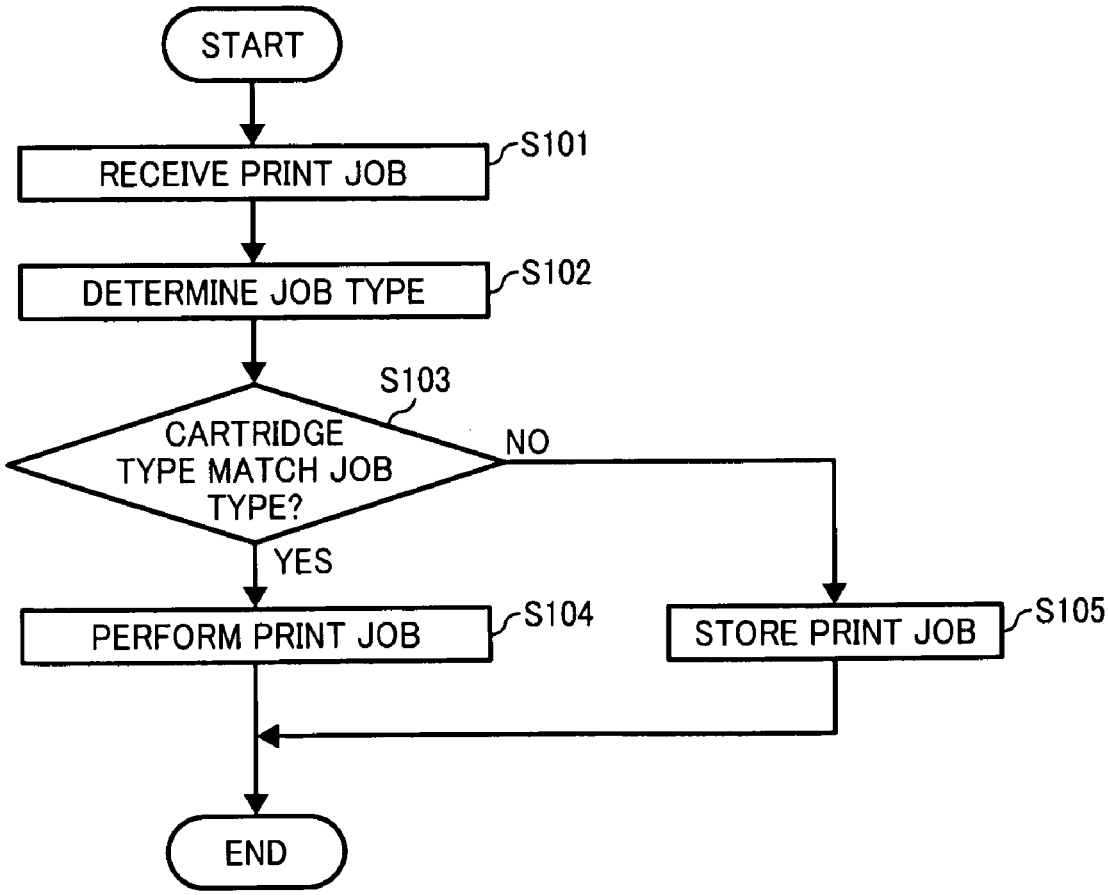
FIG. 8 is a flowchart illustrating operation of processing a print job received from the outside, performed by the printer shown in FIG. 1, according to an example embodiment of the present invention.

Referring now to FIG. 8, operation of processing a print job received from the outside, performed by the printer 100, is explained according to an example embodiment of the present invention. In this example, it is assumed that one of the regular process cartridge and the MICR process cartridge is installed onto the apparatus body 1 of the printer 100.

At S101, the communication controller 106 receives a print job from the PC 200 through the network N. The print job may include data to be printed, which may be referred to as the print data, as well as various information regarding the settings of the data to be printed, which may be referred to as job management information.

For example, at the PC 200, the user may select data to be printed, and input various job management information for the data to be printed, using the printer driver. Specifically, in this example, it is assumed that the printer driver installed on the PC 200 allows the user to select MICR printing, which prints the selected data using the MICR font, for example, by providing a check box selectable by the user. Alternatively, the PC 200 may be previously set so as to automatically generate the MICR print job when a request for printing a specific type of document is input by the user. For example, MICR printing may be automatically selected by the printer driver when the request for generating a pay check is input b the user. When the MICR print job is requested, the printer driver of the PC 200 may add property information, which indicates that the print job is the MICR print job, to the job management information of the print job. The print job, which is sent by the PC 200, is received by the communication controller 106 of the printer 100. The communication controller 106 sends the print job to the print job controller 113.

At S102, the print job controller 113 determines a type of the print job. Specifically, in this example, the print job controller 113 determines whether the print job is the MICR print job requiring the use of the MICR process cartridge, or the regular print job not requiring the use of the MICR process cartridge, for example, by referring to the job management information of the print job.

At S103, the print job controller 113 determines whether the type of the print job, which is determined at S102, matches the cartridge type of the process cartridge 2 currently installed. When it is determined that the type of the print job matches the cartridge type of the cartridge being installed ("YES" at S103), the operation proceeds to S104. When it is determined that the type of the print job does not match the cartridge type of the cartridge being installed ("NO" at S103), the operation proceeds to S105.

For example, when the process cartridge 2 being installed is the regular process cartridge, the print job controller 113 determines whether the print job is the MICR print job requiring the use of the MICR process cartridge, or the print job is the regular print job that does not require the use of the MICR process cartridge. When it is determined that the print job is the regular print job ("YES" at S103), the operation proceeds to S104. When it is determined that the print job is the MICR print job ("NO" at S103), the operation proceeds to S105.

In another example, when the process cartridge 2 being installed is the MICR process cartridge, the print job controller 113 determines whether the print job is the MICR print job requiring the use of the MICR process cartridge, or the print job is the regular print job that does not require the use of the MICR process cartridge. When it is determined that the print job is the MICR print job ("YES" at S103), the operation proceeds to S104. When it is determined that the print job is the regular print job ("NO" at S103), the operation proceeds to S105.

At S104, the print job controller 113 instructs the engine controller 108 to process the print job being received. Specifically, in this example, the printer engine 130 prints the print data using one of the regular process cartridge and the MICR process cartridge, which is currently installed onto the printer 100. The print job controller 113 may further send notification to the user that printing is performed for the print job.

At S105, the print job controller 113 causes the memory 112 to store therein the print job without processing the print job, and the operation ends. Specifically, in this example, information regarding the print job may be stored in the form manageable by the controller 101, such as in the form of a print job table 140 illustrated in FIG. 9. Referring to FIG. 9, the print job table 140 stores the index number that arbitrarily assigns to the print job, the user name identifying the sender of the print job, the job name that is assigned to the print job such as a file name of data to be printed, the time when the print job is received by the printer 100, the number of pages of the print data, and the job type indicating that the print job is the MICR print job or the regular print job. The print job controller 113 may further send notification to the user that the print job is stored.

The operation of FIG. 8 may be performed in various other ways. For example, when it is determined that the received print job is the MICR print job at S102, the operation may proceed directly to S105 without determining whether the MICR process cartridge is being installed. By automatically storing the MICR print job in the memory 112, the printed MICR document, which tends to be confidential, may be prevented from being left at the printer 100 for long time. Further, the printer 100 does not have to perform S103 such that the processing speed may increase.

In another example, when the MICR process cartridge is installed, the regular print job may be performed since the regular print job is assumed to be any print job other than the MICR print job requiring the use of MICR process cartridge. While the regular process cartridge is usually used for processing the regular print job, the MICR process cartridge may be used to process the regular print job. On the other hand, the MICR print job is prohibited from being processed by the regular process cartridge.

As described above referring to FIG. 8, since the printer 100 automatically stores the print job when the print job does not match the type of the process cartridge currently installed, the user is not required to check the process cartridge being installed onto the printer 100, for example, by physically moving to the place where the printer 100 is provided to see the type of the process cartridge being installed. Further, since the printer 100 automatically stores the print job when the print job does not match the type of the process cartridge currently installed, the user does not have to re-send the print job to the printer 100 even the print job is not processed by the printer 100.

Figure 10:
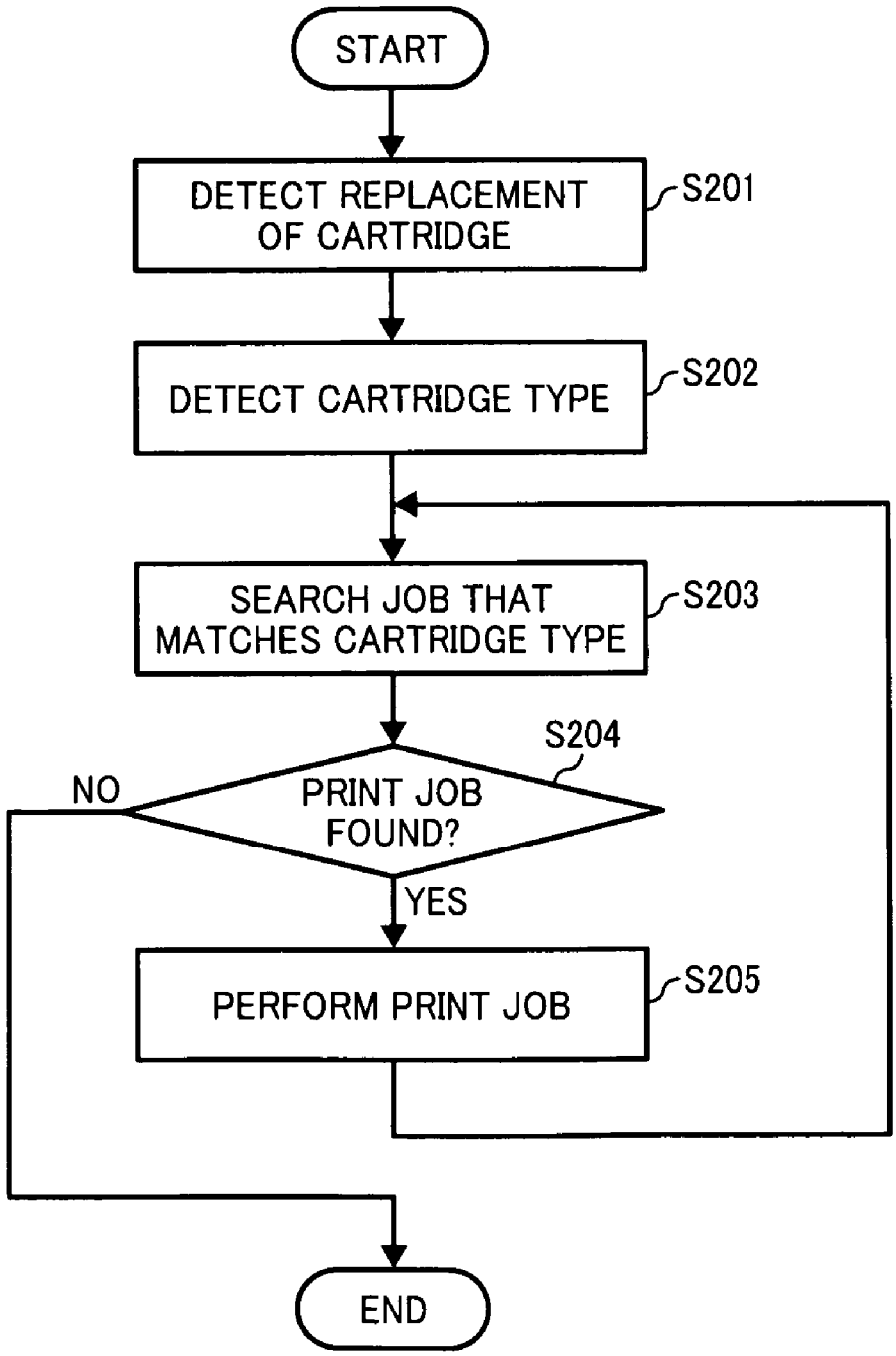
FIG. 10 is a flowchart illustrating operation of searching a print job when replacement of the process cartridge is detected, performed by the printer shown in FIG. 1, according to an example embodiment of the present invention.

Referring now to FIG. 10, operation of processing a print job stored in the printer 100, performed by the printer 100, is explained according to an example embodiment of the present invention. The operation of FIG. 10 may be performed when installation or replacement of the process cartridge 2 is detected by the detector 10. For the descriptive purpose, in this example, it is assumed that the regular process cartridge is replaced with the MICR process cartridge.

At S201, the device manager 114 detects that the process cartridge 2, which is the MICR process cartridge, is installed after the regular process cartridge is removed from the printer 100, for example, by receiving the detection signal output from the detector 10.

At S202, the device manager 104 detects the cartridge type of the process cartridge 2 that is installed, for example, by referring to information regarding the cartridge type stored in the memory 112. Alternatively, the device manager 104 may detect the cartridge type using the detection signal output by the detector 10. The device manager 104 may further send information regarding the cartridge type to the print job controller 113.

At S203, the print job controller 113 searches a print job that matches the cartridge type of the process cartridge 2 being installed. Specifically, in this example, it is assumed that the process cartridge 2 is the MICR process cartridge. In such case, the print job controller 113 searches the MICR print job, for example, by referring to the property information stored in the print job table 140.

At S204, the print job controller 113 determines whether the print job that matches the cartridge type of the cartridge currently installed is found. When it is determined that the print job that matches the cartridge type is found ("YES" at S204), the operation proceeds to S205. When it is determined that no print job that matches the cartridge type is found ("NO" at S204), the operation ends.

At S205, the print job controller 113 reads the print data that corresponds to the print job being found out from the memory 112, and sends the print data to the engine controller 108. The engine controller 108 causes the printer engine 130 to form an image of the print data. After processing, the print job controller 113 may delete the print job as well as information regarding the print job being processed from the print job table 140. When printing is completed, the operation returns to S203 to search another print job that matches the cartridge type.

As described above referring to FIG. 10, when installation or replacement of the process cartridge 2 is detected, the printer 100 automatically searches a print job that matches the type of the process cartridge currently installed and forms an image of print data for the print job that is obtained through searching. After installing or replacing the process cartridge, the user is not required to perform further processing to obtain the printed image.

Figure 11:
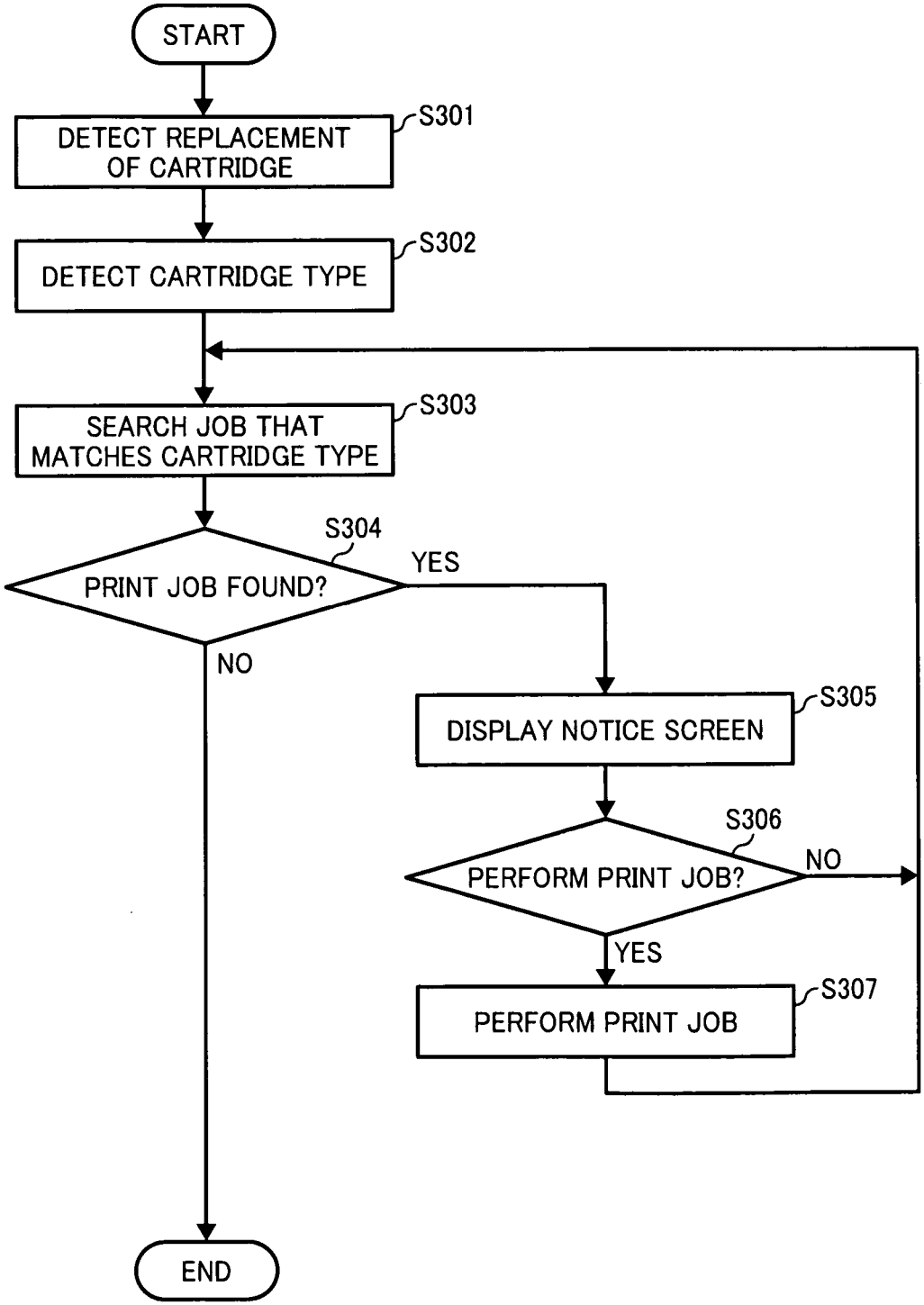
FIG. 11 is a flowchart illustrating operation of searching a print job when replacement of the process cartridge is detected, performed by the printer shown in FIG. 1, according to an example embodiment of the present invention.

Referring now to FIG. 11, operation of processing a print job stored in the printer 100, performed by the printer 100, is explained according to an example embodiment of the present invention. The operation of FIG. 11 may be performed when installation or replacement of the process cartridge 2 is detected by the detector 10. For the descriptive purpose, in this example, it is assumed that the regular process cartridge is replaced with the MICR process cartridge.

S301 to S303 may be performed in a substantially similar manner as described above referring to S201 to S203 of FIG. 10.

At S304, the print job controller 113 determines whether the print job that matches the cartridge type of the cartridge currently installed is found. When it is determined that the print job that matches the cartridge type is found ("YES" at S304), the operation proceeds to S305. When it is determined that no print job that matches the cartridge type is found ("NO" at S304), the operation ends.

At S305, the print job controller 113 requests the UI controller 111 to output a message that asks the user whether to print the print data of the print job being found, for example, by displaying a screen including such message onto the display 121 (FIG. 7) together with information regarding the print data to be printed. In response to the message, the user may input a user instruction through the display 121 or any key that is provided with the operation panel 120.

At S306, the print job controller 113 determines whether the user instruction that requests printing of the print data is received through the UI controller 111. When it is determined that the user instruction that requests printing of the print data is received ("YES" at S306), the operation proceeds to S307.

When it is determined that the user instruction that requests printing of the print data is not received ("NO" at S306), the operation returns to S303 to search another print job that matches the cartridge type.

At S307, the print job controller 113 reads the print data that corresponds to the print job being found out from the memory 112, and sends the print data to the engine controller 108. The engine controller 108 causes the printer engine 130 to form an image of the print data. After processing, the print job controller 113 may delete the print job as well as information regarding the print job being processed from the print job table 140. When printing is completed, the operation returns to S303 to search another print job that matches the cartridge type.

As described above referring to FIG. 11, when installation or replacement of the process cartridge 2 is detected, the printer 100 automatically searches a print job that matches the type of the process cartridge currently installed and reports the user that the print job is found. After installing or replacing the process cartridge 2, the user is not required to perform further processing to obtain information indicating whether there is any unprocessed print job that matches the type of the process cartridge currently installed. Further, in this example, the user is able to select whether to print or not print the print job that is found.

Figure 12:
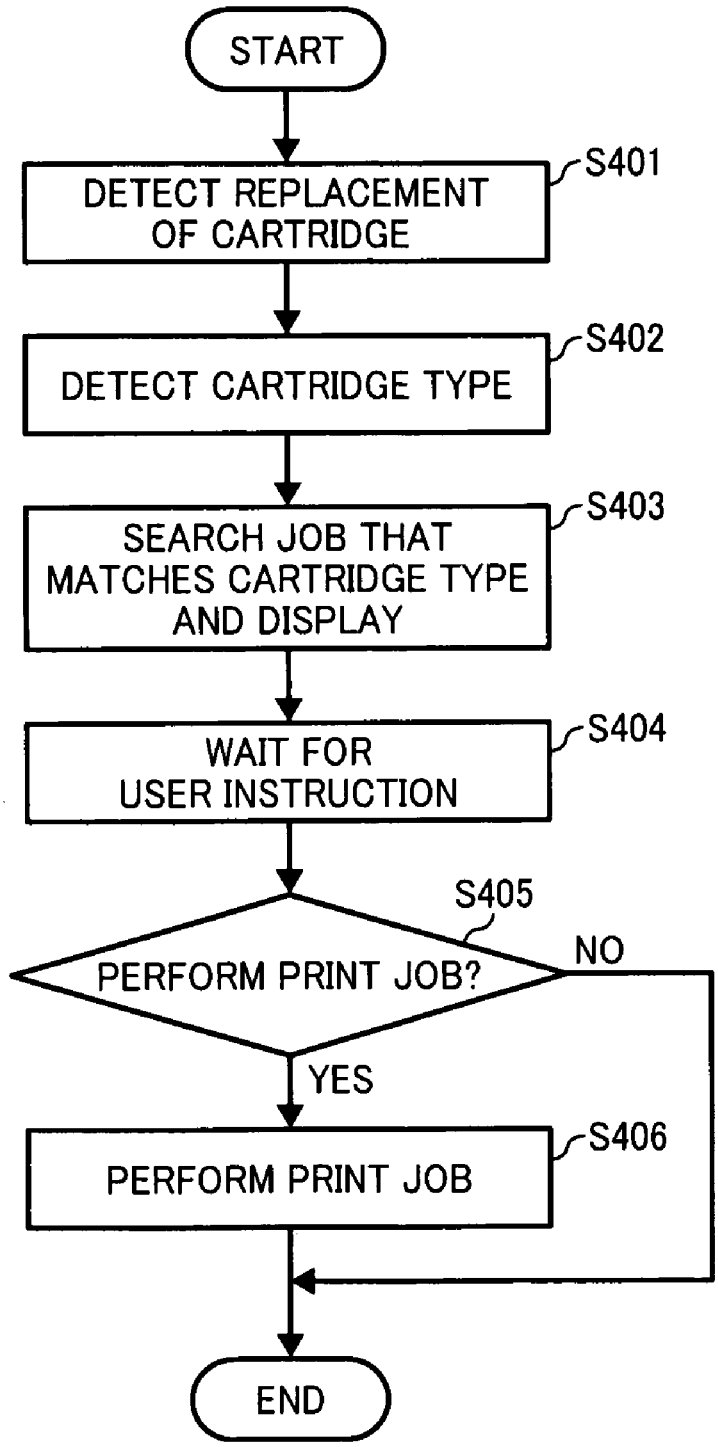
FIG. 12 is a flowchart illustrating operation of searching a print job when replacement of the process cartridge is detected, performed by the printer shown in FIG. 1, according to an example embodiment of the present invention.

Referring now to FIG. 12, operation of processing a print job stored in the printer 100, performed by the printer 100, is explained according to an example embodiment of the present invention. The operation of FIG. 12 may be performed when installation or replacement of the process cartridge 2 is detected by the detector 10. For the descriptive purpose, in this example, it is assumed that the regular process cartridge is replaced with the MICR process cartridge.

S401 to S402 may be performed in a substantially similar manner as described above referring to S201 to S202 of FIG. 10.

At S403, the print job controller 113 searches a print job that matches the cartridge type of the process cartridge 2 being installed. Specifically, in this example, it is assumed that the process cartridge 2 is the MICR process cartridge. In such case, the print job controller 113 searches the MICR print job, for example, by referring to the property information stored in the print job table 140. Further, in this example, the print job controller 113 obtains all MICR print jobs that are stored in the printer 100, and displays a list of MICR print jobs that are found to the user.

Figure 13:
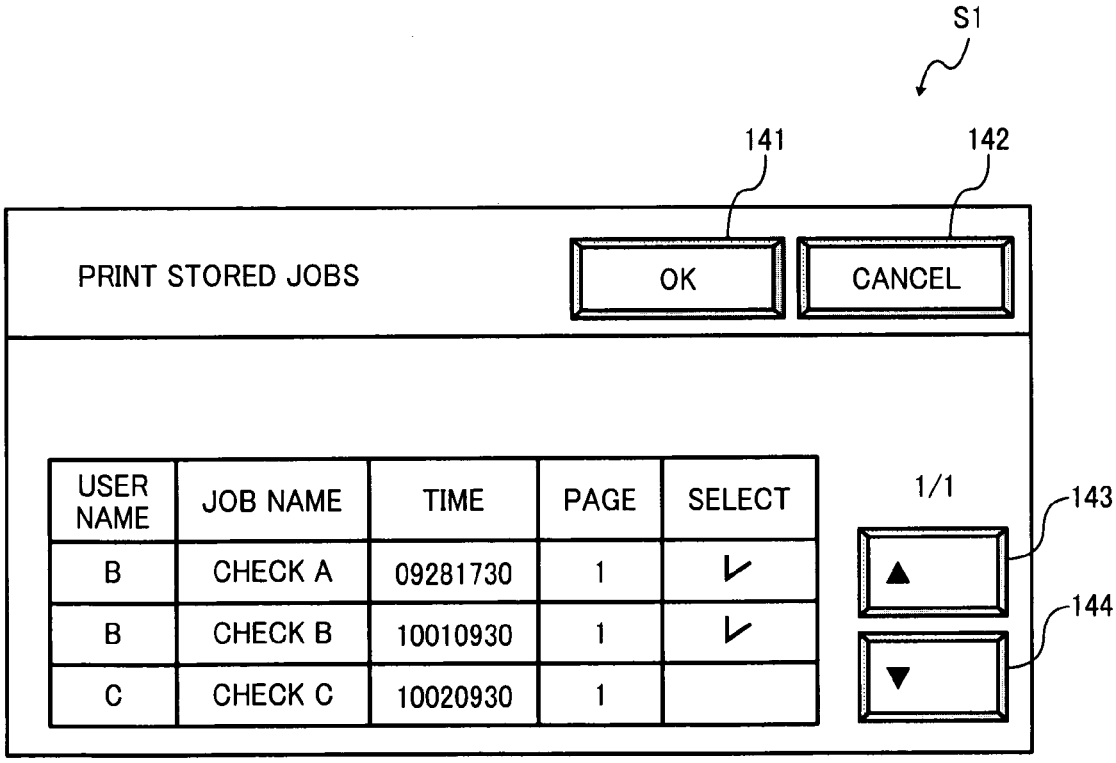
FIG. 13 is an example screen displayed by the printer shown in FIG. 1, when the operation of FIG. 12 is performed.

For example, the UI controller 111 may cause the operation panel 120 to display a screen S1 illustrated in FIG. 13 on the display 121. The screen S1 includes information regarding the MICR print jobs that are found at S403, which may be displayed in the form of table. The user name includes information regarding a user name that sends the MICR print job. The job name includes information regarding the name assigned to the MICR print job. The time includes information regarding the date and time that the MICR print job is received by the printer 100. The page includes information regarding the number of pages to be printed. Such information regarding the MICR print job may be obtainable from the print job table 140 stored in the printer 100.

Referring back to FIG. 12, at S404, the print job controller 113 waits for user instruction. The screen S1 of FIG. 13 further includes a "SELECT" box, an "OK" key 141, a "CANCEL" key 142, a "BACK" key 143, and a "NEXT" key 144, each of which may be selected by the user.

The "SELECT" box allows the user to select any number of MICR print jobs that are displayed. In one example, when the user desires to select a MICR print job having the job name "CHECK A", the user may touch or press any portion of the raw that includes information regarding the MICR print job "CHECK A". When touched or pressed, the check mark as illustrated in FIG. 13 may be displayed on the "SELECT" box. In another example, the MICR print job may be selected using any key provided on the operation panel 120.

Alternatively, the user may not select any MICR print job to be printed. In such case, the user may press the "OK" key 141 without selecting any MICR print jobs that are displayed. Alternatively, the printer 100 may be provided with a timer that counts a time period from when the list of MICR print jobs is displayed to the user. When no user instruction is detected for a predetermined time period, the printer 100 may assume that there is no MICR print job that is selected by the user for printing.

The "OK" key 141 may allow the user to confirm the selection previously made by the user, for example, through the "SELECT" box. The "CANCEL" key 142 may allow the user to cancel the selection previously made by the user, for example, through the "SELECT" box. The "BACK" key 143 may allow the user to move toward the MICR print job that is listed first, for example, when more than one screen for the MICR print jobs is available. The "NEXT" key 144 may allow the user to move toward the MICR print job that is listed last, for example, when more than one screen for the MICR print jobs is available. After selecting the MICR print job, the user may confirm the selection by pressing the "OK" key 141. When the "OK" key 141 is pressed, information regarding the selected MICR print job may be stored in the memory 112. Specifically, in the example shown in FIG. 13, the print job having the job name "CHECK A" and the print job having the job name "CHECK B" are selected.

Referring back to FIG. 12, at S405, the print job controller 113 determines whether the user instruction for printing at least one MICR print job is input through the operation panel 120. When the user instruction for printing at least one MICR print job is received through the UI controller 111, the print job controller 113 determines that printing is to be performed ("YES" at S405), and the operation proceeds to S406. When the user instruction for printing at least one MICR print job is not received, the print job controller 113 determines that the printing is not to be performed ("NO" at S405), and the operation ends.

At S406, the print job controller 113 reads the print data that corresponds to the print job being selected from the memory 112, and sends the print data to the engine controller 108. The engine controller 108 causes the printer engine 130 to form an image of the print data for the selected print jobs. After processing, the print job controller 113 may delete the print job as well as information regarding the print job being processed from the print job table 140. When printing is completed for all MICR print jobs that are selected, the operation ends.

As described above referring to FIG. 12, when installation or replacement of the process cartridge 2 is detected, the printer 100 automatically searches a print job that matches the type of the process cartridge currently installed and displays a list of print jobs that are found to the user. After installing or replacing the process cartridge 2, the user is not required to perform further processing to obtain information regarding the unprocessed print job that matches the type of the process cartridge currently installed. Further, in this example, the user is able to select one or more print jobs that the user desires to print from the list of print jobs at one time.

Figure 14:
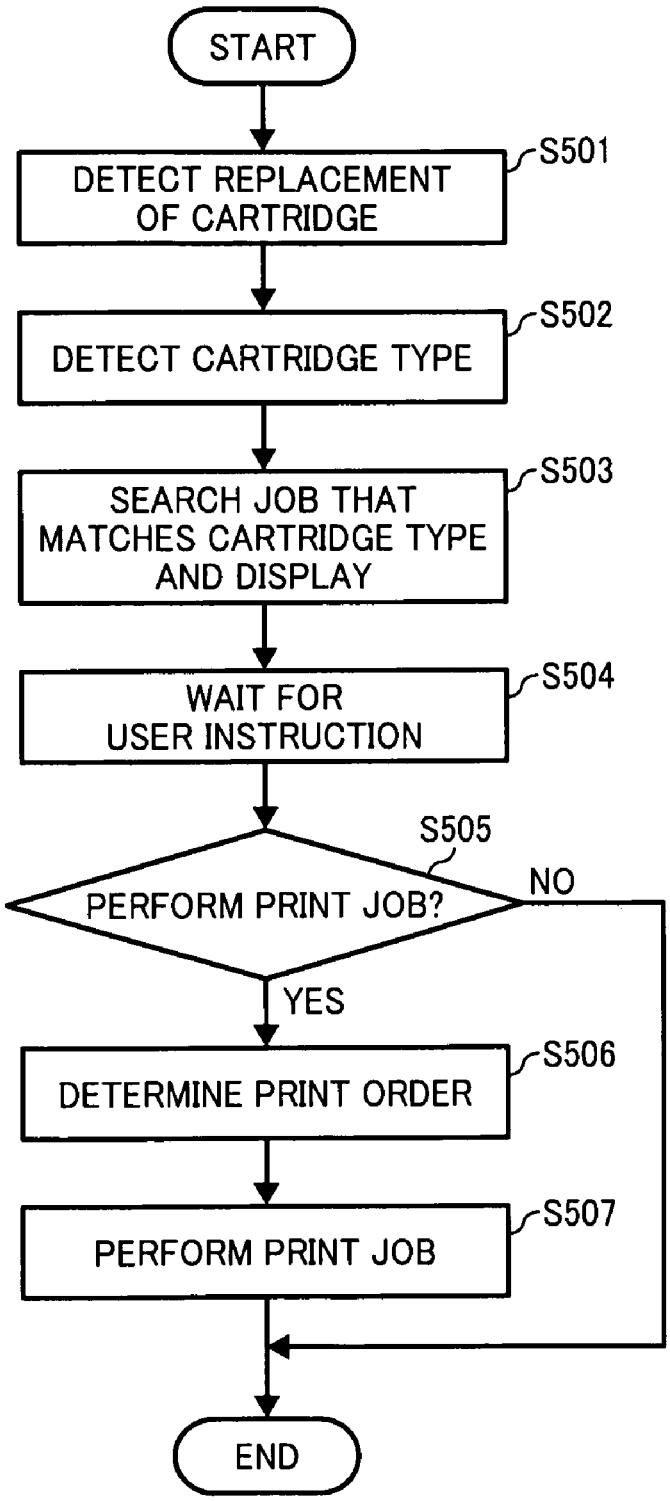
FIG. 14 is a flowchart illustrating operation of searching a print job when replacement of the process cartridge is detected, performed by the printer shown in FIG. 1, according to an example embodiment of the present invention.

Referring now to FIG. 14, operation of processing a print job stored in the printer 100, performed by the printer 100, is explained according to an example embodiment of the present invention. The operation of FIG. 14 may be performed when installation or replacement of the process cartridge 2 is detected by the detector 10. For the descriptive purpose, in this example, it is assumed that the regular process cartridge is replaced with the MICR process cartridge.

Figure 15:
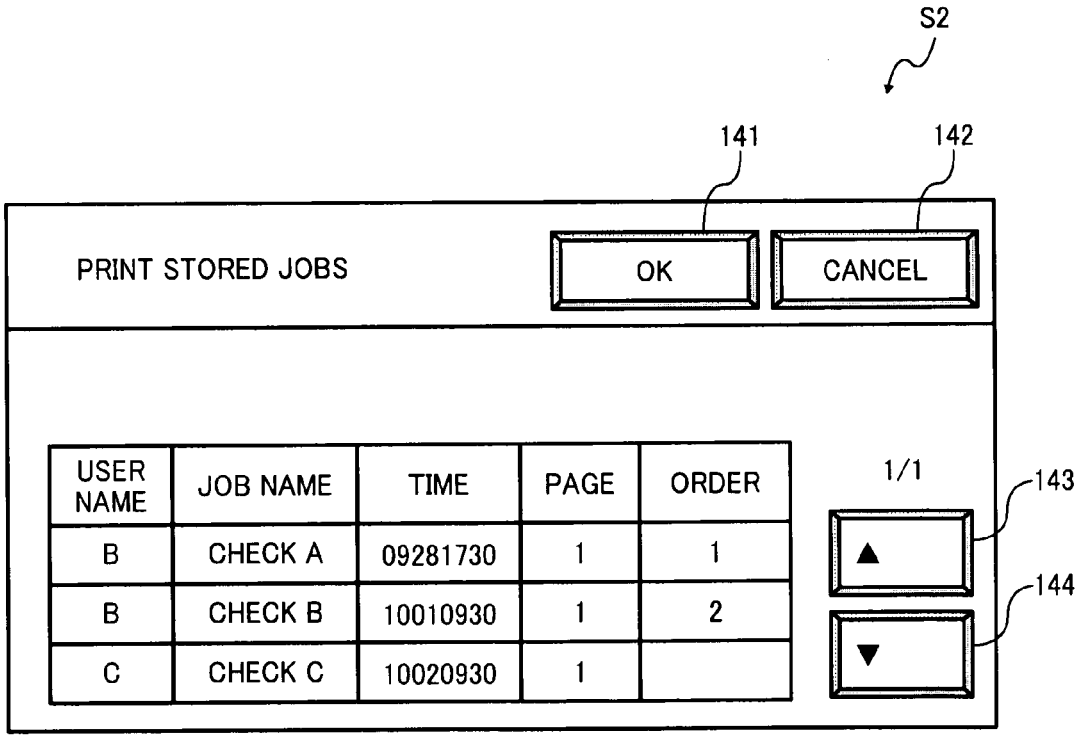
FIG. 15 is an example screen displayed by the printer shown in FIG. 1, when the operation of FIG. 14 is performed.

S501 to S504 may be performed in a substantially similar manner as described above referring to S401 to S404 of FIG. 12. In this example, after all MICR print jobs are found at S503, the UI controller 111 may cause the operation panel 120 to display a screen S2 illustrated in FIG. 15 on the display 121. The screen S2 includes various information that are substantially similar to the information included in the screen S1 of FIG. 13. The differences include the replacement of the "SELECT" box of FIG. 13 with the "ORDER" box of FIG. 15.

The "ORDER" box has the function of allowing the user to select any number of MICR print jobs that are displayed, which may be provided by the "SELECT" box of FIG. 13. The "ORDER" box additionally has the function of allowing the user to determine an order in which each MICR print job that is selected is processed for printing. For example, it is assumed that the user desires to print the MICR print job having the job name "CHECK A" first and print the MICR print job having the job name "CHECK B" second. In such case, the user may firstly touch or press any portion of the raw that includes information regarding the MICR print job "CHECK A". In response, the display 121 may display the number "1" on the "ORDER" box to indicate that the selected MICR print job is to be printed first. The user may secondly touch or press any portion of the raw that includes information regarding the MICR print job "CHECK B". In response, the display 121 may display the number "2" on the "ORDER" box to indicate that the selected MICR print job is to be printed second. After selecting the MICR print job in the desired order, the user may confirm the selection and the order by pressing the "OK" key 141. When the "OK" key 141 is pressed, information regarding the selected MICR print job and its order of processing may be stored in the memory 112. For example, the order of processing may be stored as part of the job management information in a corresponding manner with the print data to be printed.

With this function, the user may be able to determine the order of printing each MICR print job at the same time when the user selects each MICR print job for printing. In another example, the selection or the order of MICR print job may be input using any key provided on the operation panel 120.

Alternatively, the user may not select any MICR print job to be printed. In such case, the user may press the "OK" key 141 without selecting any MICR print jobs that are displayed. Alternatively, the printer 100 may be provided with a timer that counts a time period from when the list of MICR print jobs is displayed to the user. When no user instruction is detected for a predetermined time period, the printer 100 may assume that there is no MICR print job that is selected by the user for printing.

Referring back to FIG. 14, at S505, the print job controller 113 determines whether the user instruction for printing at least one MICR print job is input through the operation panel 120. When the user instruction for printing at least one MICR print job is received through the UI controller 111, the print job controller 113 determines that printing is to be performed ("YES" at S505), and the operation proceeds to S506. When the user instruction for printing at least one MICR print job is not received, the print job controller 113 determines that the printing is not to be performed ("NO" at S505), and the operation ends.

At S506, the print job controller 113 determines the order of processing the selected print jobs according to the job management information from the memory 112.

At S507, the engine controller 108 causes the printer engine 130 to print the print data in the order specified by the job management information, which is determined at S506. After being processed, the print job may be deleted as well as information regarding the print job. When printing is completed for all MICR print jobs that are selected, the operation ends.

The operation of FIG. 14 may be performed in various other ways. For example, instead of allowing the user to determine the order of processing each MICR print job that is selected, the printer 100 may be caused to process the MICR print job in the order previously defined by default or according to the user preference. For example, the MICR print jobs may be processed in the order in which the print data is received, or in the reversed order of the order in which the print data is received. In another example, the MICR print jobs may be processed in the alphabetical order of the user name of the user generating the print job, or in the reverse order of such alphabetical order. In order to set the order of processing, referring back to FIG. 7, the user may alternatively select the setting key 128. When the setting key 128 is selected, the display 121 may display a screen that allows the user to input information regarding various settings of the printer 100 including information regarding the order of processing the print job when more than one print job are selected. The information input by the user may be stored in the memory 112 of the printer 100, which may be referred by the print job controller 113 at the time of processing the stored print job.

As described above referring to FIG. 14, when installation or replacement of the process cartridge 2 is detected, the printer 100 automatically searches a print job that matches the type of the process cartridge currently installed and displays a list of print jobs that are found to the user. After installing or replacing the process cartridge 2, the user is not required to perform further processing to obtain information regarding the unprocessed print job that matches the type of the process cartridge currently installed. Further, in this example, the user is able to select that print job that the user desires to print from the list of print jobs, as well as the order of processing the selected print jobs.

Figure 16:
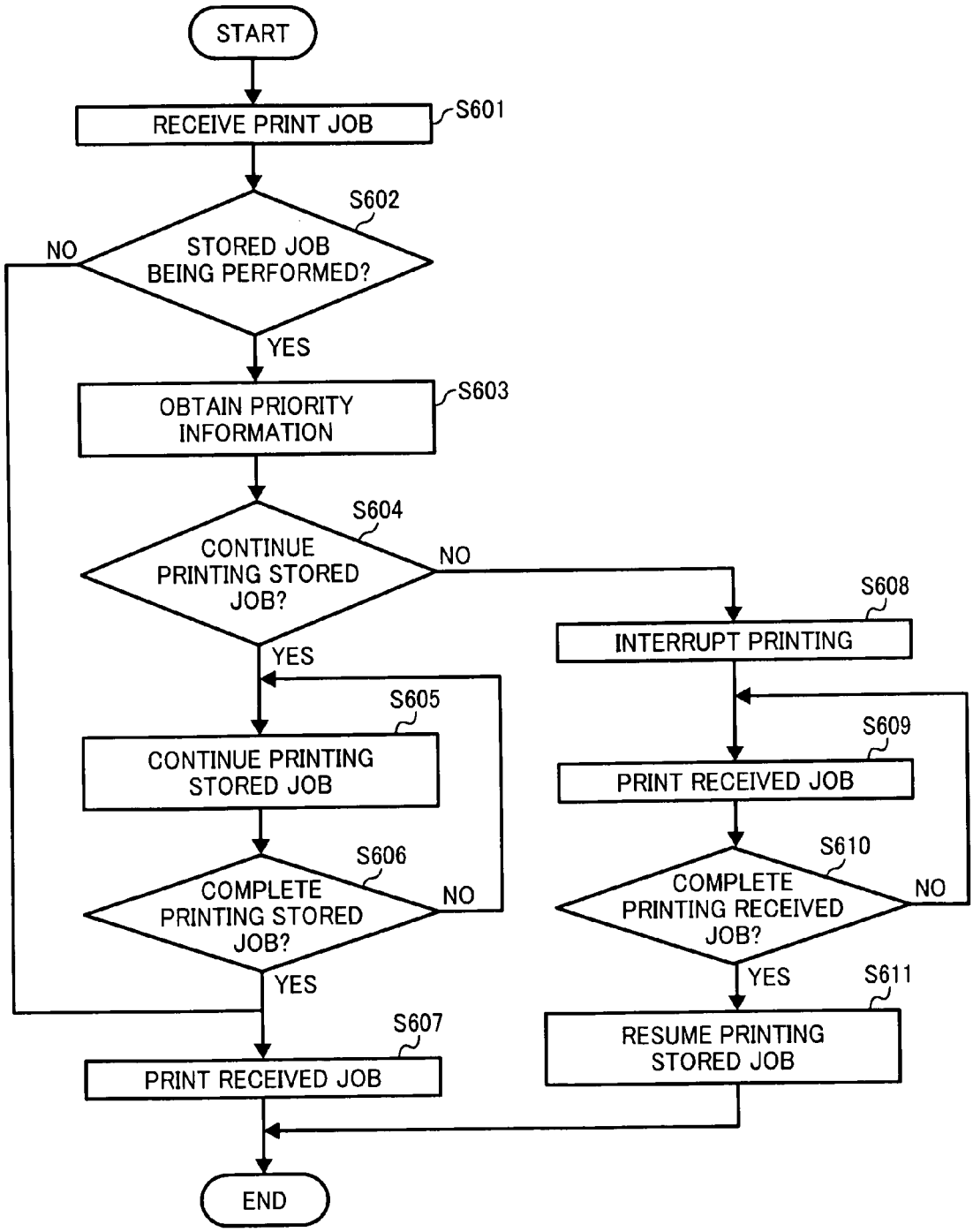
FIG. 16 is a flowchart illustrating operation of processing a print job received from the outside when processing a print job stored in the printer shown in FIG. 1, performed by the printer shown in FIG. 1, according to an example embodiment of the present invention.

Referring now to FIG. 16, operation of processing two types of a print job, performed by the printer 100, is explained according to an example embodiment of the present invention. The operation of FIG. 16 may be performed when a print job is received from the outside apparatus such as the PC 200. For the descriptive purpose, in this example, it is assumed that the MICR process cartridge is installed into the apparatus body 1 of the printer 100.

At S601, the communication controller 106 of the printer 100 receives a print job from the PC 200 through the network N. The print job controller 113 may be notified by the communication controller 106 of the receipt of the print job.

The print job may be generated at the PC 200 in a substantially similar manner as described above referring to S100 of FIG. 8. Specifically, in this example, job management information may include priority information indicating the degree of urgency in processing. For example, when the user desires to have the printed image immediately, the user may add the priority information indicating the high level of priority, for example, through the printer driver installed onto the PC 200. When the high level of priority is detected, the printer 100 may process the print job received from the PC 200 even when the printer 100 is in the middle of processing print jobs that are stored. The priority information may be expressed, for example, in the numerical value such as "1" or "2", or in the form of letter such as "A" or "B".

At S602, the print job controller 113 determines whether any print job is currently being performed by the printer 100. Since this example assumes that the MICR process cartridge is installed, the print job controller 113 determines whether any MICR print job, which is stored, is currently being performed by the printer 100. When it is determined that the MICR print job is being performed ("YES" at S602), the operation proceeds to S603. When it is determined that the MICR print job is not being performed ("NO" at S602), the operation proceeds to S607.

At S603, the print job controller 113 reads priority information out from the print job that is received at S601.

At S604, the print job controller 113 determines whether to continue processing the MICR print job by referring to the priority information. When it is determined that the priority information indicates that the received print job is low in priority relative to the current MICR print job, the print job controller 113 determines to continue processing the stored print job ("YES" at S604), and the operation proceeds to S605. When it is determined that the priority information indicates that the received print job is high in priority relative to the current MICR print job, the print job controller 113 determines to interrupt processing the stored print job ("NO" at S604), and the operation proceeds to S608.

At S605, the print job controller 113 continues processing the MICR print job. At this time, the received print job is stored in the memory 112.

At S606, the print job controller 113 determines whether processing of the MICR print job is completed. When it is determined that processing of the MICR print job is completed ("YES" at S606), the operation proceeds to S607. When it is determined that processing of the MICR print job is not completed ("NO" at S606), the operation repeats S606.

At S607, the print job controller 113 reads the print data of the print job that is received at S601 from the memory 112, and sends the print data to the engine controller 108. The engine controller 108 causes the printer engine 130 to form an image of the print data, and the operation ends.

At S604, when it is determined that the priority information indicates that the received print job is high in priority relative to the current MICR print job ("NO" at S604), the operation proceeds to S608 to interrupt processing of the MICR print job being currently performed.

At S609, the print job controller 113 processes printing of the print data of the print job received at S601.

At S610, the print job controller 113 determines whether processing of the received print job is completed. When it is determined that processing of the received print job is completed ("YES" at S610), the operation proceeds to S611. When it is determined that processing of the received print job is not completed ("NO" at S610), the operation repeats S609.

At S611, the print job controller 113 resumes processing of the MICR print job, which is interrupted at S608, and the operation ends after completion of the MICR print job.

The operation of FIG. 16 may be performed in various other ways. For example, the priority information may not be specified by the user at the PC 200. Alternatively, any information such as information regarding the network protocol, port number, or IP address, each of which may be included in the print job or any information that may be sent through the network during communication may be used as the priority information. For example, the IP address of the PC 200 may be used as the priority information. In such case, the printer 100 determines that any print job sent from the PC 200 having the specific IP address is to be firstly processed. In order to cause the printer 100 to operate in this manner, referring back to FIG. 7, the user may select the setting key 128. When the setting key 128 is selected, the display 121 may display a screen that allows the user to input information regarding various settings of the printer 100 including information indicating the criteria, which may be used to determine whether to process the stored print job first or the received print job first. Alternatively, using the setting key 128, the user may simply set whether to process the stored print job first or the received print job first without the specific rule. The information input by the user may be stored in the memory 112, which may be referred by the print job controller 113 at the time of processing the stored and received print jobs substantially at the same time.

As described above referring to FIG. 16, when processing of the stored printing job is performed after detection of installation or replacement of the process cartridge 2, a print job received from the outside may be performed by the printer 100 in a timely manner depending on the urgency in processing such print job.

As illustrated in any one of FIGS. 11 to 16, the printer 100 of FIG. 1 displays information regarding the print job that matches the process cartridge that is currently installed. Alternatively, the printer 100 may display information regarding all print jobs that are stored in the memory 112 of the printer 100.

Figure 17:
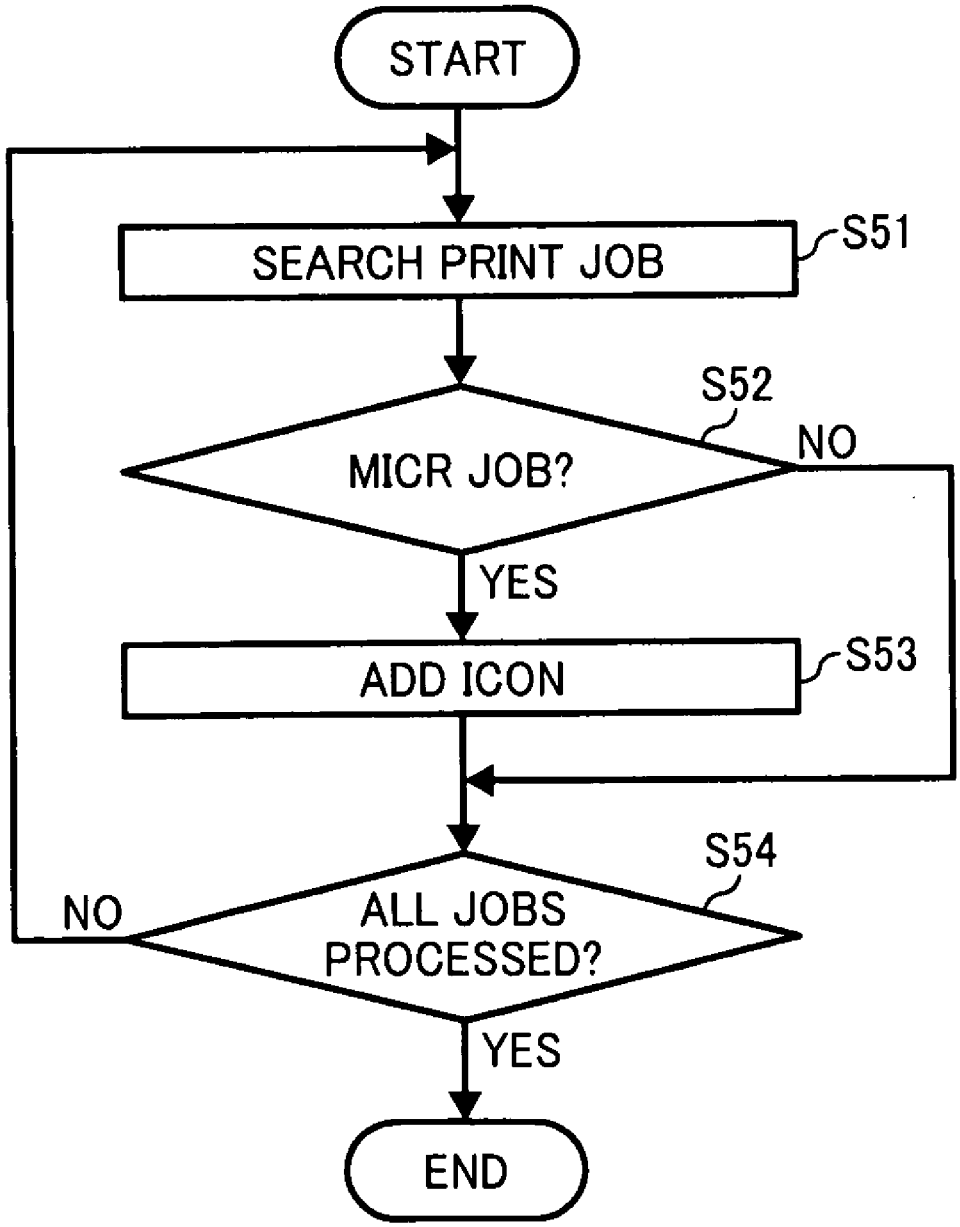
FIG. 17 is a flowchart illustrating operation of searching a print job, performed by the printer shown in FIG. 1, according to an example embodiment of the present invention.

Referring to FIG. 17, operation of displaying a print job stored in the printer 100, performed by the printer 100, is explained according to an example embodiment of the present invention. The operation of FIG. 17 may be performed at any desired timing. In one example, the operation of FIG. 17 may be performed upon the user instruction through the operation panel 120. In another example, the operation of FIG. 17 may be performed when installation or replacement of the process cartridge 2 is detected by the detector 10. In another example, the operation of FIG. 17 may be performed when the power of the printer 100 is turned on or when the printer 100 is switched from the energy save mode to the operation mode.

At S51, the print job controller 113 searches through the memory 112 of the printer 100 to select a print job for display to the user. The print job controller 113 may search through the print job table 140 of FIG. 9, and obtain one print job as a selected print job.

At S52, the print job controller 113 determines whether the print job that is selected at S51 is the MICR print job, for example, by referring to the property information. When it is determined that the print job is the MICR print job ("YES" at S52), the operation proceeds to S53. When it is determined that the print job is the regular print job ("NO" at S52), the operation proceeds to S54.

At S53, the print job controller 133 adds an indicator, which indicates that the print job selected at S51 is the MICR print job, such as an icon. Such indicator is to be displayed to the user together with other information regarding the selected print job.

At S54, the print job controller 113 determines whether all print jobs stored in the memory 112 are checked. When it is determined that all print jobs are processed ("YES" at S54), the operation ends. When it is determined that all print jobs are not processed ("NO" at S54), the operation returns to S51 to search and select another print job.

Figure 18:
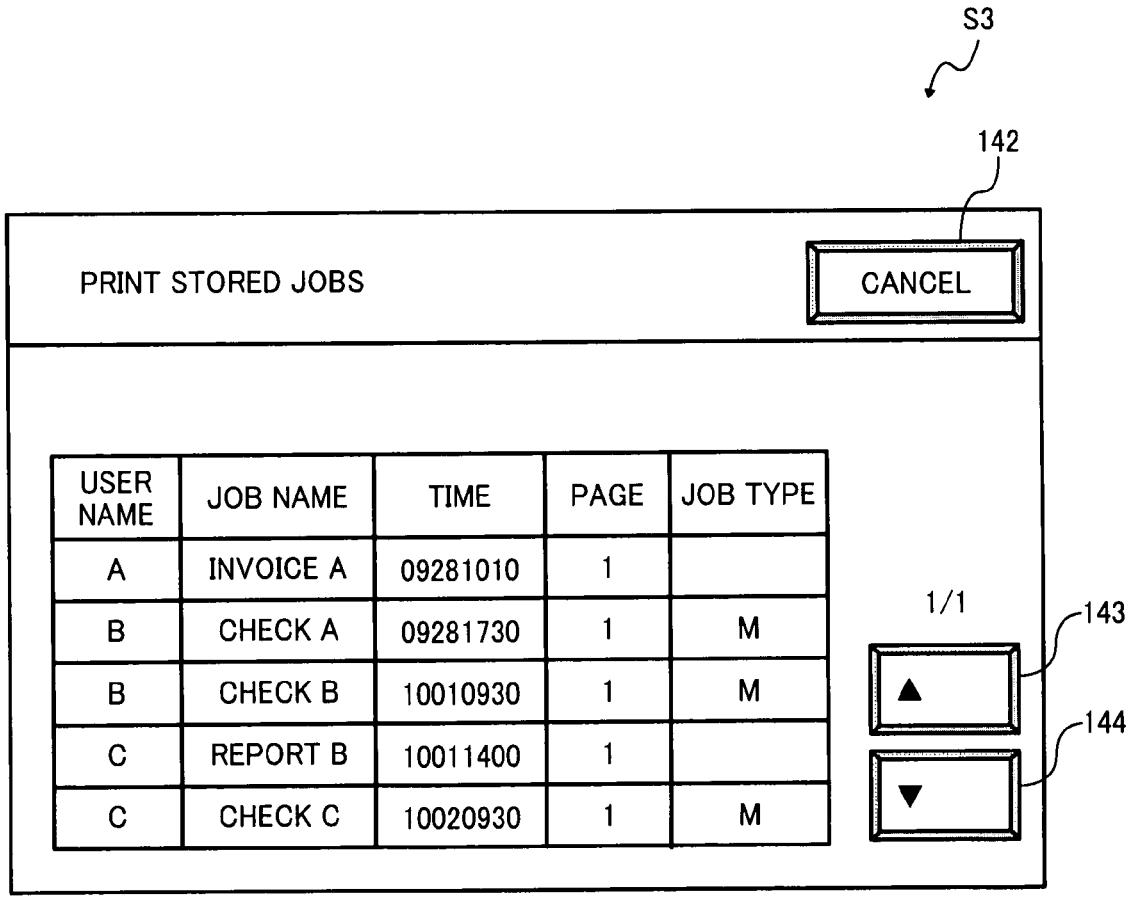
FIG. 18 is an example screen displayed by the printer shown in FIG. 1, when the operation of FIG. 17 is performed.

After performing the operation of FIG. 17, the printer 100 may display a screen S3 illustrated in FIG. 18 on the display 121 of the operation panel 120. The screen S3 of FIG. 18 is substantially similar to the screen S1 of FIG. 13. The differences include the addition of indicator indicating that the print job is the MICR print job. As shown in FIG. 18, the indicator may be expressed as the icon "M". Alternatively, the print job that corresponds to the MICR print job may be displayed so as to have the appearance different from the appearance of the regular print job, such as by using different color or shading. By displaying two types of print jobs differently, the user may be able to easily distinguish between two types of print jobs.

In any one of the above examples, it is assumed that all print jobs are stored in the same print job table, such as the print job table 140 of FIG. 9. Alternatively, the print jobs may be stored in different print job tables depending on the type of the print job.

Figure 19:
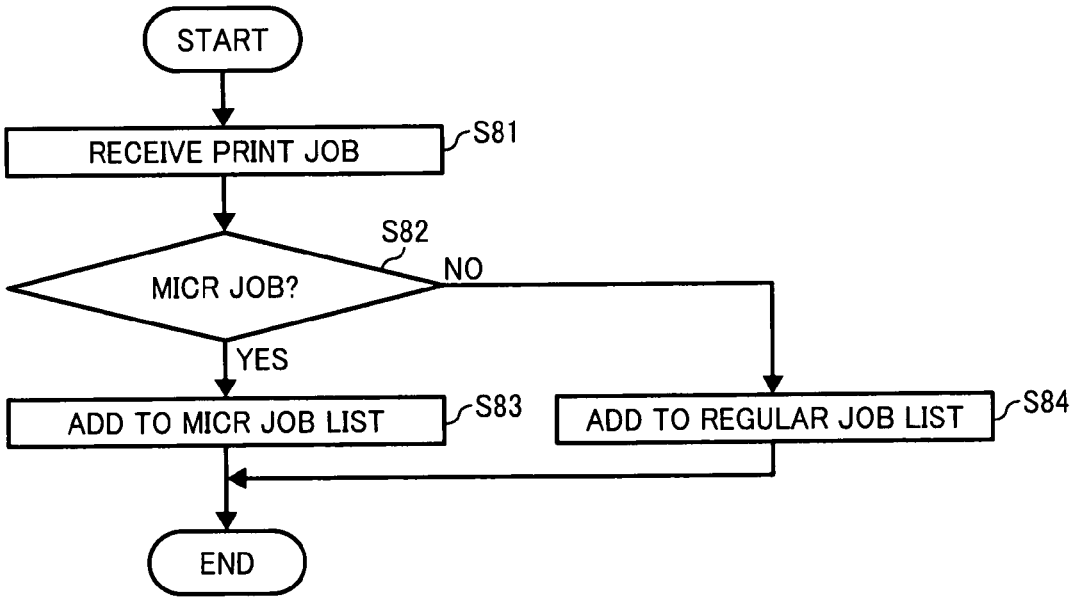
FIG. 19 is a flowchart illustrating operation of processing a print job received from the outside, performed by the printer shown in FIG. 1, according to an example embodiment of the present invention.

Referring now to FIG. 19, operation of processing a print job received from the outside, performed by the printer 100, is explained according to an example embodiment of the present invention. In this example, it is assumed that one of the regular process cartridge and the MICR process cartridge is installed onto the apparatus body 1 of the printer 100.

At S81, the communication controller 106 receives a print job from the PC 200 through the network N in a substantially similar manner as described above referring to S100 of FIG. 8.

At S82, the print job controller 113 determines whether the received print job is the MICR print job or the regular print job, for example, by referring to the job management information of the print job. When it is determined that the received print job is the MICR print job ("YES" at S82), the operation proceeds to S83. When it is determined that the received print job is the regular print job ("NO" at S83), the operation proceeds to S84.

At S83, the print job controller 113 causes the memory 112 to store therein the MICR print job without processing the print job, and the operation ends. Specifically, in this example, information regarding the MICR print job may be stored in an area designated for the MICR print job, such as in a MICR print job table.

At S84, the print job controller 113 causes the memory 112 to store therein the regular print job without processing the print job, and the operation ends. Specifically, in this example, information regarding the regular print job may be stored in an area designated for the regular print job and different from the area where the MICR print job is stored, such as in a regular print job table.

Figure 20:
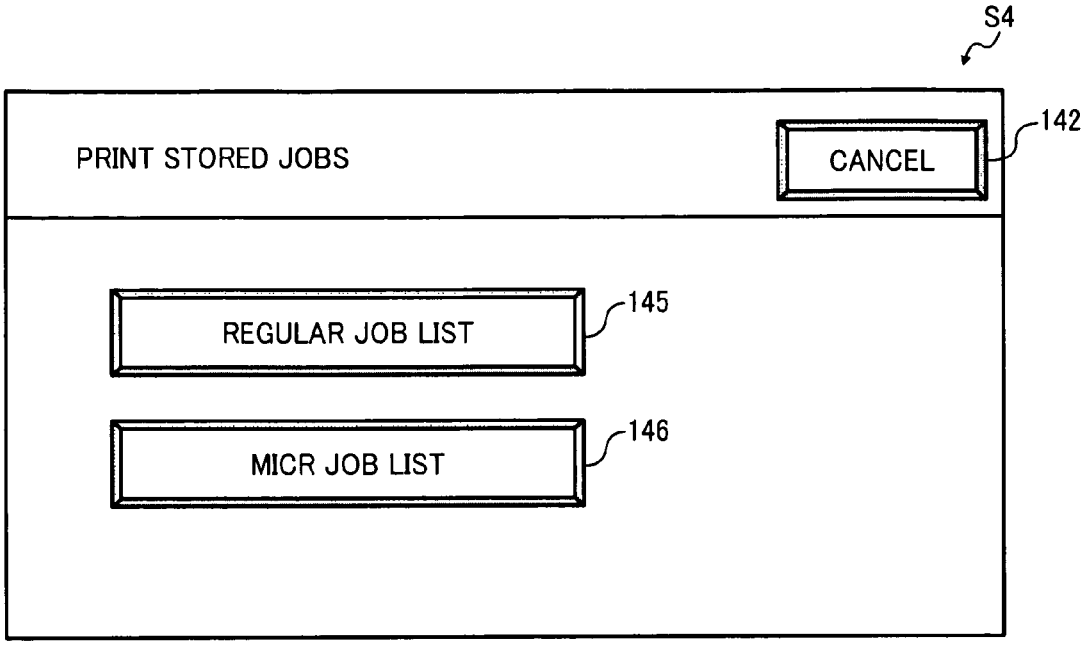
FIG. 20 is an example screen displayed by the printer shown in FIG. 1, according to an example embodiment of the present invention.

By storing two types of print jobs separately from each other, the print jobs may be easily managed by the printer 100. For example, upon user instruction, the printer 100 may display a screen S4 illustrated in FIG. 20 on the display 121 of the operation panel 120. Referring to FIG. 20, the screen S4 includes the "CANCEL" key 142, the "REGULAR JOB LIST" key 145, and the "MICR JOB LIST" key 146. When the "REGULAR JOB LIST" key 145 is selected by the user, the display 121 may display a list of regular print jobs that are stored in the memory 112 of the printer 100, for example, by referring to the regular print job table. When the "MICR JOB LIST" key 146 is selected by the user, the display 121 may display a list of MICR print jobs that are stored in the memory 112 of the printer 100, for example, by referring to the MICR print job table.

Figure 21:
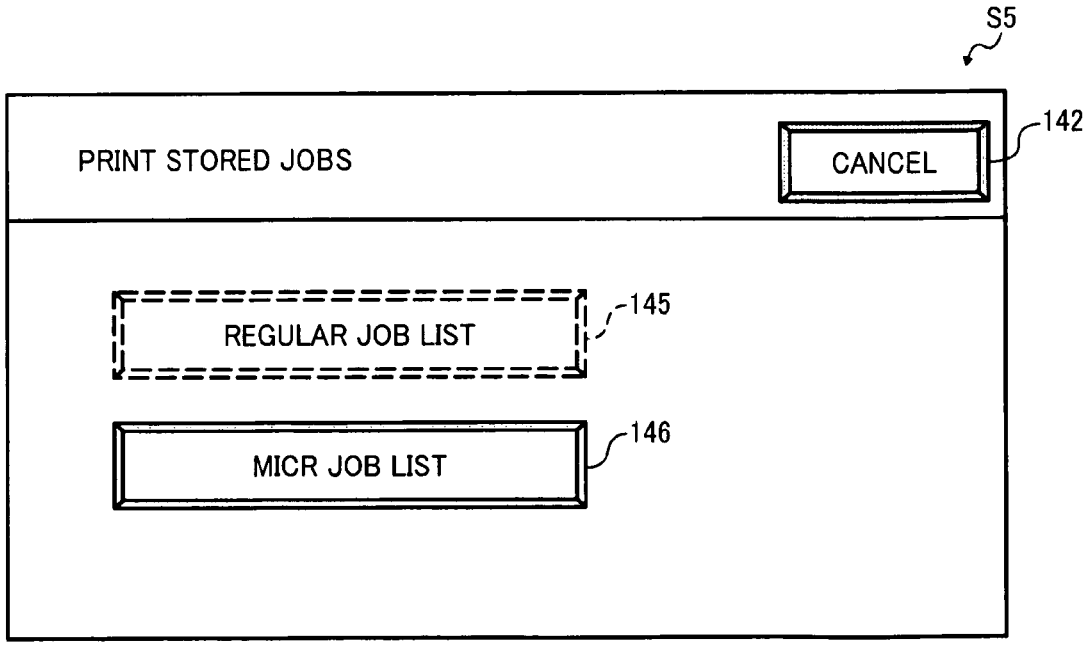
FIG. 21 is an example screen displayed by the printer shown in FIG. 1, according to an example embodiment of the present invention.

In another example, upon receiving the user instruction, the printer 100 may first determine the type of the process cartridge 2 being installed, and change the appearance of the "REGULAR JOB LIST" key 145 or the "MICR JOB LIST" key 146 based on information regarding the type of the process cartridge 2 being installed. For example, when it is determined that the process cartridge 2 being installed is the MICR process cartridge, the printer 100 may display a screen S5 illustrated in FIG. 21. Referring to FIG. 21, the "REGULAR JOB LIST" key 145 is displayed differently from the display of the "MICR JOB LIST" key 146. Further, the "REGULAR JOB LIST" key 145 may be made inactivated so that the "REGULAR JOB LIST" key 145 is not selectable by the user. Alternatively, the controller 101 may disregard the selection made by the user even when the "REGULAR JOB LIST" key 145 is selected. Alternatively, the controller 101 may cause the operation panel 120 to display an error message when the "REGULAR JOB LIST" key 145 is selected.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the spirit and scope of the present invention, and all such modifications are intended to be included within the scope of the present invention.

For example, elements and/or features of different illustrative embodiments may be combined with each other and/or substituted for each other within the scope of this disclosure and appended claims.

Further, in any one of the above-described examples, the printer 100 may cause the operation panel 120 to display information regarding the print jobs differently depending on the user who is currently logged onto the system. For example, the printer 100 may request the user to provide the user name and the password. When authenticated, the printer 100 may only search a print job that is sent by the user currently logged on. In a substantially similar manner, the printer 100 may print the print data only for the print job sent by the user currently logged on.

In another example, the printer 100 may be implemented in various other ways. For example, the process cartridge 2 being installed onto the apparatus body 1 of the printer 100 may not be limited to the process cartridge 2 shown in FIG. 2. Further, the hardware structure of the printer 100 is not limited to the structure shown in FIG. 2.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, involatile memory cards, ROM (read-only-memory), etc.

Alternatively, any one of the above-described and other methods of the present invention may be implemented by ASIC, prepared by interconnecting an appropriate network of conventional component circuits or by a combination thereof with one or more conventional general purpose microprocessors and/or signal processors programmed accordingly.

What is claimed is:

1. An image forming apparatus, comprising:

an image forming device provided with one of a first process cartridge removable from the image forming apparatus and a second process cartridge removable from the image forming apparatus;

a storage device configured to store therein a print job;

a detector configured to detect installation of one of the first process cartridge and the second process cartridge onto the image forming apparatus; and a controller configured to be activated by the detector when installation of one of the first process cartridge and the second process cartridge is detected and to automatically search through the storage device to obtain a print job that matches the type of one of the first process cartridge and the second process cartridge that is currently installed.

2. The apparatus of claim 1, further comprising:

a communication device configured to receive a print job from a network, wherein the controller is further configured to determine whether the received print job matches the type of one of the first process cartridge and the second process cartridge that is currently installed, and to automatically store in the storage device the received print job when the received print job does not match the type of one of the first process cartridge and the second process cartridge that is currently installed.

3. The apparatus of claim 2, wherein the controller is further configured to store print job property information indicating a type of the received print job together with the received print job, the type of the received print job corresponding to one of the first process cartridge and the second process cartridge.

4. The apparatus of claim 2, wherein the storage device includes:

a first job table configured to store the print job that matches the type of the first process cartridge; and a second job table configured to store the print job that matches the type of the second process cartridge, wherein, when the received print job matches the type of the first process cartridge and the first process cartridge is not currently installed, the controller is configured to store the received print job in the first job table, and wherein, when the received print job matches the type of the second process cartridge and the second process cartridge is not currently installed, the controller is configured to store the received print job in the second job table.

5. The apparatus of claim 2, wherein the controller is further configured to automatically cause the image forming device to form an image of print data for the print job that matches the type of one of the first process cartridge and the second process cartridge that is currently installed, when the print job that matches the type of one of the first process cartridge and the second process cartridge that is currently installed is found.

6. The apparatus of claim 2, further comprising:

a user interface configured to report the user when the print job that matches the type of one of the first process cartridge and the second process cartridge that is currently installed is found and to wait for a user instruction for printing, wherein the controller is further configured to cause the image forming device to form an image of print data for the print job that matches the type of one of the first process cartridge and the second process cartridge that is currently installed when the user instruction for printing is received through the user interface.

7. The apparatus of claim 6, wherein, when the print job that matches the type of one of the first process cartridge and the second process cartridge that is currently installed includes a plurality of print jobs, the user interface is further configured to display a list of the plurality of print jobs and to wait for a user instruction for selecting at least one of the plurality of print jobs for printing from the list of the plurality of print jobs, and wherein:

the controller is further configured to cause the image forming device to form an image of print data for the at least one of the plurality of print jobs selected by the user instruction, when the user instruction for selecting at least one of the plurality of print jobs for printing is received.

8. The apparatus of claim 7, wherein, when the user instruction for selecting at least one of the plurality of print jobs for printing indicates that more than one print job is selected for printing, the user interface is further configured to receive a user instruction for specifying the order of processing the selected print jobs, and wherein:

the controller is further configured to cause the image forming device to form an image of print data for the selected print jobs in the order specified by the user instruction.

9. The apparatus of claim 1, further comprising:

a communication device configured to receive a print job from a network, wherein the controller is further configured to obtain priority information indicating the level of urgency in processing the received print job relative to processing the stored print job that matches the type of one of the first process cartridge and the second process cartridge that is currently installed, to determine which one of the received print job and the stored print job is to be processed first by the image forming device according to the priority information to generate a determination result, and to cause the image forming device to form an image of print data for the received print job and the stored print job in the order specified by the determination result.

10. The apparatus of claim 1, further comprising:

a communication device configured to receive a print job from a network, wherein the controller is further configured to determine whether the received print job requires the use of the second process cartridge, and to automatically store in the storage device the received print job and print job property information indicating a type of the received print job when the received print job requires the use of the second process cartridge, the second process cartridge being a MICR process cartridge.

11. The apparatus of claim 10, further comprising:

a user interface configured to search through the storage device to obtain the print job that matches the type of the second process cartridge and to display information regarding the print job that matches the type of the second process cartridge at desired timing.

12. The apparatus of claim 11, wherein:

the controller is further configured to search through the storage device to obtain the print job that matches the type of the first process cartridge in addition to the print job that matches the type of the second process cartridge, and wherein:

the user interface is further configured to display information regarding the print job that matches the type of the first process cartridge, the information regarding the print job that matches the type of the first process cartridge having appearance different from the appearance of the information regarding the print job that matches the type of the second process cartridge.

13. The apparatus of claim 12, wherein:

the user interface is further configured to wait for a user instruction for selecting at least one of the information regarding the print job that matches the type of the second process cartridge and the information regarding the print job that matches the type of the first process cartridge, and wherein:

the controller is further configured to make information regarding the print job that matches the type of one of the first process cartridge and the second process cartridge that is not currently installed to be unselectable by the user.

14. An image forming apparatus, comprising:

means for forming an image of print data using one of a first process cartridge removable from the image forming apparatus and a second process cartridge removable from the image forming apparatus;

means for storing therein a print job;

means for detecting installation of one of the first process cartridge and the second process cartridge onto the image forming apparatus; and means for automatically searching through the means for storing to obtain a print job that matches the type of one of the first process cartridge and the second process cartridge that is currently installed, the means for searching being automatically activated by the means for detecting when installation of one of the first process cartridge and the second process cartridge is detected.

15. An image forming method, comprising:

storing a print job previously received by an image forming apparatus in a storage device;

detecting installation of one of a first process cartridge and a second process cartridge onto the image forming apparatus, the first process cartridge and the second process cartridge each being removable from the image forming apparatus;

searching through the storage device to obtain a print job that matches the type of one of the first process cartridge and the second process cartridge that is currently installed, the searching being automatically performed when the detecting detects installation of one of the first process cartridge and the second process cartridge; and forming an image of print data for the print job that matches the type of one of the first process cartridge and the second process cartridge that is currently installed.

* * * * *